US009368942B2

(12) United States Patent
Ban et al.

(10) Patent No.: US 9,368,942 B2
(45) Date of Patent: Jun. 14, 2016

(54) IGNITION PLUG AND IGNITION SYSTEM

(71) Applicant: NGK SPARK PLUG CO., LTD., Nagoya-shi, Aichi (JP)

(72) Inventors: Kenji Ban, Gifu-ken (JP); Katsutoshi Nakayama, Shanghai (CN)

(73) Assignee: NGK Spark Plug Co., Ltd., Aichi (JP)

( * ) Notice: Subject to any disclaimer, the term of this patent is extended or adjusted under 35 U.S.C. 154(b) by 200 days.

(21) Appl. No.: 14/264,102

(22) Filed: Apr. 29, 2014

(65) Prior Publication Data

US 2014/0328001 A1 Nov. 6, 2014

(30) Foreign Application Priority Data

May 1, 2013 (JP) ..... 2013-096130
Apr. 28, 2014 (JP) ..... 2014-092683

(51) Int. Cl.
*F23Q 3/00* (2006.01)
*H01T 13/20* (2006.01)

(52) U.S. Cl.
CPC ..... *H01T 13/20* (2013.01)

(58) Field of Classification Search
CPC ..... H01T 13/20
USPC ..... 361/253
See application file for complete search history.

(56) References Cited

U.S. PATENT DOCUMENTS 4,700,103 A * 10/1987 Yamaguchi ..... H01T 13/39 313/141
6,552,476 B1 4/2003 Hanashi et al. ..... 313/141
2002/0145429 A1* 10/2002 Yorita ..... F02P 17/12 324/380
2012/0019120 A1 1/2012 Nakayama et al. ..... 313/141
2013/0148254 A1 6/2013 Katsuraya et al. ..... 361/253
2014/0014050 A1 1/2014 Ikeda ..... 123/3
2014/0076257 A1 3/2014 Ikeda et al. ..... 123/143 B

FOREIGN PATENT DOCUMENTS

EP 2416462 2/2012 ..... H01T 13/32
GB 2354550 3/2001 ..... H01T 13/46
JP 2010-102864 5/2010 ..... F02P 13/00

(Continued)

OTHER PUBLICATIONS

Notification of Reason for Rejection dated Feb. 20, 2015 issued in connection with corresponding Japanese Patent Application 2014-092683 (including English translation).

(Continued)

*Primary Examiner* — Thienvu Tran
*Assistant Examiner* — Lucy Thomas
(74) *Attorney, Agent, or Firm* — Kusner & Jaffe

(57) ABSTRACT

An ignition plug that promotes expansion of flame and enhances spark corrosion resistance, said plug includes a center electrode; a tubular insulator holding the center electrode; a tubular metallic shell holding the insulator; and a ground electrode having a bent portion and a facing end surface. A plurality of peak voltages can be applied to the center electrode after application of a voltage for trigger discharge thereto. When a forward end surface of the center electrode and the facing end surface are projected onto a plane orthogonal to axial direction of the center electrode, the projection of the center of the forward end surface and the projection of the facing end surface overlap with each other, and the projection of a remote-side edge portion of the facing end surface which is located on the side remote from the bent portion is located within the projection of the forward end surface.

8 Claims, 24 Drawing Sheets

(56) References Cited

FOREIGN PATENT DOCUMENTS

| | | | |
|---|---|---|---|
| WO | WO 2012032846 | 3/2012 | ..... F02P 3/00 |
| WO | WO 2012/111700 | 8/2012 | ..... F02P 23/04 |
| WO | WO 2012/111701 | 8/2012 | ..... F02B 23/08 |

OTHER PUBLICATIONS

European Search Report dated Dec. 12, 2014 received in connection with European Patent Application No. 14 16 6663.

* cited by examiner

SECOND EMBODIMENT

THIRD EMBODIMENT

FOURTH EMBODIMENT

FOURTH EMBODIMENT

COMPARATIVE EXAMPLE 2

COMPARATIVE EXAMPLE 5

RESULTS OF DISCHARGE RATIO EVALUATION TEST

| SAMPLE NO | DIAMETER OF FORWARD END SURFACE (mm) | SIZE OF FACING END SURFACE (mm) | EVALUATION | |
|---|---|---|---|---|
| s5 | 1.2 | 0.7*1.7 | AA | FIRST EMBODIMENT |
| s6 | 1.1 | 0.7*1.5 | AA | FIRST EMBODIMENT |
| s7 | 0.9 | 0.7*1.4 | BB | FIRST EMBODIMENT |
| s8 | 0.8 | 0.7*1.3 | BB | FIRST EMBODIMENT |
| s9 | 1.2 | 0.7*1.7 | AA | SECOND EMBODIMENT |
| s10 | 1.2 | 0.7*1.0 | BB | THIRD EMBODIMENT |
| s11 | 1.1 | 0.7*0.8 | BB | THIRD EMBODIMENT |
| s12 | 1.2 | 0.7(DIAMETER) | BB | FOURTH EMBODIMENT |
| s13 | 1.2 | 0.7*0.6 | XX | COMPARATIVE EXAMPLE 4 |
| s14 | 1.2 | 0.7*1.1 | CC | COMPARATIVE EXAMPLE 5 |
| s15 | 1.2 | 0.7*1.5 | CC | COMPARATIVE EXAMPLE 6 |
| s16 | 0.8 | 1.6(DIAMETER) | XX | COMPARATIVE EXAMPLE 7 |

XX: 50% OR LESS
CC: 50-70%
BB: 70-90%
AA: 90-100%

FIG. 17

RESULTS OF DURABILITY EVALUATION TEST

| SAMPLE NO | DIAMETER OF FORWARD END SURFACE (mm) | FACING END SURFACE · THICKNESS (mm) | AREA A ($mm^2$) | AREA B ($mm^2$) | AREA C ($mm^2$) | AREA B+C ($mm^2$) | EVALUATION |
|---|---|---|---|---|---|---|---|
| s17 | 1.2 | 0.7*1.7 | 1.13 | 0.63 | 1.75 | 2.38 | AAA |
| s18 | 1.2 | 0.7*0.2*1.7 | 1.13 | 0.63 | 0.50 | 1.13 | AA |
| s19 | 1.2 | 0.7*0.15*1.7 | 1.13 | 0.63 | 0.38 | 1.01 | BB |
| s20 | 1.6 | Φ1.0*0.8 | 2.01 | 0.79 | 2.51 | 3.30 | AAA |
| s21 | 1.6 | Φ1.0*0.39 | 2.01 | 0.79 | 1.22 | 2.01 | AA |
| s22 | 1.6 | Φ1.0*0.3 | 2.01 | 0.79 | 0.94 | 1.73 | BB |

BB 0.2 mm OR GREATER
AA: 0.1 - 0.2 mm
AAA: 0.1 mm OR LESS

FIG. 18

MODIFICATION 2

MODIFICATION 2

MODIFICATION 3

MODIFICATION 3

FOURTH EXAMPLE EVALUATION RESULTS

| SAMPLE NO | DIAMETER OF FORWARD END SURFACE (mm) | SIZE OF FACING END SURFACE (mm) | DISCHARGE RATIO EVALUATION | DURABILITY EVALUATION | |
|---|---|---|---|---|---|
| s23 | 1.2 | 0.7*1.7 | AA | BB | COMPARATIVE EXAMPLE 8 |
| s24 | 1.2 | 0.7*1.7 | AA | AAA | FIRST EMBODIMENT |
| s25 | 1.2 | 0.7*1.7 | CC | AAA | COMPARATIVE EXAMPLE 9 |

XX: 50% OR LESS
CC: 50-70%
BB: 70-90%
AA: 90-100%

ΔΔΔΔ

BB: 0.2 mm OR GREATER
AA: 0.1 - 0.2 mm
AAA: 0.1 mm OR LESS

FIG. 26

IGNITION PLUG AND IGNITION SYSTEM

FIELD OF THE INVENTION

The present invention relates to an ignition plug.

BACKGROUND OF THE INVENTION

An ignition plug used for an internal combustion engine of, for example, of a vehicle includes a center electrode, and a ground electrode which has a bent portion and is disposed to face the center electrode. In order to enhance the ignition performance of such an ignition plug, there has been proposed a method of generating plasma on the basis of spark discharge (trigger discharge) to thereby expand flame (See WO2012/111700 A2, WO2012/111701 A2 and Japanese Patent Application Laid-Open (kokai) No. 2010-102864; hereinafter respectively referred to as Patent Documents 1 through 3).

However, in the case of the ignition plugs disclosed in Patent Documents 1 and 2, trigger discharge occurs not only at the distal end of the ground electrode but also at a position near a bent portion of the ground electrode at a high ratio. Therefore, these ignition plugs have a problem in that, when trigger discharge occurs at a position near the bent portion of the ground electrode, the growth of plasma is hindered by the ground electrode, and expansion of flame is restricted. Also, the ignition plug disclosed in Patent Document 3 has a problem in that, since trigger discharge occurs, in a concentrated manner, on a surface of the ground electrode which faces the center electrode, the ground electrode consumes locally, and the overall spark-consumption resistance of the ground electrode deteriorates.

SUMMARY OF THE INVENTION

The present invention has been accomplished in order to solve the above-mentioned problems, and can be realized as the following modes or application examples.

(1) According to one mode of the present invention, an ignition plug is provided. This ignition plug comprises a center electrode; a tubular insulator which holds the center electrode such that a forward end portion of the center electrode projects from the insulator; a tubular metallic shell which holds the insulator; and a ground electrode whose one end is joined to the metallic shell and whose other end is a free end, the ground electrode having a bent portion formed between the one end and the other end, and a facing end surface which faces a forward end surface of the forward end portion of the center electrode, wherein a plurality of peak voltages can be applied to the center electrode after application of a voltage for trigger discharge thereto; and when the forward end surface and the facing end surface are projected onto a plane orthogonal to an axial direction of the center electrode, a projection of the center of the forward end surface and a projection of the facing end surface overlap with each other, and a projection of a remote-side edge portion of the facing end surface which is located on a side remote from the bent portion is located within the projection of the forward end surface. According to the ignition plug of this mode, since a plurality of peak voltages are applied to the center electrode after application of a voltage for trigger discharge thereto, ions and radicals produced between the center electrode and the ground electrode (between the forward end surface and the facing end surface) by trigger discharge can be vibrated, whereby growth of plasma can be promoted. In addition, since the center electrode and the ground electrode are disposed such that the projection of the remote-side edge portion is located within the projection of the forward end surface, the remote-side edge portion can be used for trigger discharge. Therefore, plasma can be generated at a position near the other end of the ground electrode which is located on the side remote from the bent portion and is a free end. Thus, in a process of growing plasma through application of a plurality of peak voltages to the center electrode, it is possible to prevent the growth of plasma from being hindered by the ground electrode, etc. Accordingly, the ignition plug of the present mode can promote expansion of flame. Also, since the center electrode and the ground electrode are disposed such that the projection of the center of the forward end surface and the projection of the facing end surface overlap with each other, not only the facing end surface of the ground electrode but also the other end and a surface (side surface) adjacent to the facing end surface can be utilized for spark discharge. Therefore, as compared with a structure in which only the facing end surface is utilized for spark discharge, local consumption of the facing end surface can be suppressed, and the overall spark-consumption resistance of the ignition plug can be enhanced.

(2) In the ignition plug of the above-described mode, the remote-side edge portion may be an edge portion of the facing end surface which is located at an end of the facing end surface on the other end side in a direction from the bent portion toward the other end. According to the ignition plug of this mode, the remote-side edge portion is located at the end on the other end side. Therefore, plasma can be generated and grown in an open space; in other words, in a space where the ground electrode, etc. are not present.

(3) In the ignition plug of the above-described mode, the distance between the remote-side edge portion and the circumference of the forward end surface may be smaller than the distance between a near-side edge portion of the facing end surface which is located on a side near the bent portion and the circumference of the forward end surface. According to the ignition plug of this mode, the ratio of generation of spark discharge at the remote-side edge portion can be increased as compared with the ratio of generation of spark discharge at the near-side edge portion. Therefore, growth of plasma can be promoted further.

(4) In the ignition plug of the above-described mode, the near-side edge portion may be an edge portion of the facing end surface which is located at an end of the facing end surface on the bent portion side in a direction from the other end toward the bent portion. According to the ignition plug of this mode, the ratio of generation of spark discharge at the near-side edge portion can be decreased more. Therefore, it is possible to prevent the growth of plasma from being hindered by the ground electrode (the bent portion, etc.).

(5) In the ignition plug of the above-described mode, the forward end surface may be circular and have a diameter of 1.1 mm or greater. According to the ignition plug of this mode, since the forward end surface is relatively large, the distance between the facing end surface, excluding the remote-side edge portion, and the forward end surface can be made relatively large. Therefore, the ratio of generation of spark discharge at the facing end surface, excluding the remote-side edge portion, can be decreased further, and the ratio of generation of spark discharge at the remote-side edge portion can be increased.

(6) In the ignition plug of the above-described mode, the ground electrode may have a base member, and an electrode tip joined to the base member on the other end side and having the facing end surface. According to the ignition plug of this mode, the spark-consumption resistance of the ground electrode can be enhanced.

(7) In the ignition plug of the above-described mode, the electrode tip may have a side surface adjacent to the facing end surface and satisfy relational expressions A>B and A≤(B+C), where A represents the area of the forward end surface, B represents the area of a region of the facing end surface which is located within the projection of the forward end surface, and C represents the area of a region of the side surface which is located within the projection of the forward end surface. According to the ignition plug of this mode, since B is smaller than A, in addition to the facing end surface, the side surface adjacent to the facing end surface can be utilized for spark discharge. The greater the value of C, the higher the ratio at which the side is used for spark discharge. Therefore, local consumption of the facing end surface can be suppressed, whereby the overall spark-consumption resistance of the ignition plug can be enhanced.

(8) In the ignition plug of the above-described mode, the electrode tip may be smaller in width than the base member, and at least a portion of the electrode tip may project from the base member in the direction from the bent portion toward the other end. According to the ignition plug of this mode, the ratio of generation of spark discharge at the remote-side edge portion can be increased.

(9) In the ignition plug of the above-described mode, the plurality of peak voltages may be peak voltages of a voltage which has a fixed amplitude and changes periodically. According to the ignition plug of this mode, since the voltage applied to the center electrode has a fixed amplitude and changes periodically, ions and radicals produced between the center electrode and the ground electrode (between the forward end surface and the facing end surface) by trigger discharge can be vibrated stably.

(10) According to another mode of the present invention, there is provided an ignition system which comprises the ignition plug of the above-described mode; and a voltage supply section which supplies the voltage for trigger discharge and the plurality of peak voltages to the center electrode. According to the ignition system of this mode, expansion of flame in the ignition plug can be promoted, and the spark-consumption resistance of the ignition plug can be enhanced.

The present invention can be realized in other various forms other than the ignition plug. For example, the present invention can be realized as a method of manufacturing an ignition plug or a method of manufacturing an ignition system.

BRIEF DESCRIPTION OF THE DRAWINGS

FIG. 17 is an explanatory view showing the results of a discharge ratio evaluation test of a second example, the diameter of the forward end surface and the size of the facing end surface of each sample.

FIG. 18 is an explanatory view showing the results of a durability evaluation test of a third example.

FIG. 26 is an explanatory view showing the results of a discharge ratio evaluation test and a durability evaluation test in the fourth example.

DETAILED DESCRIPTION OF THE INVENTION

Figure 1:
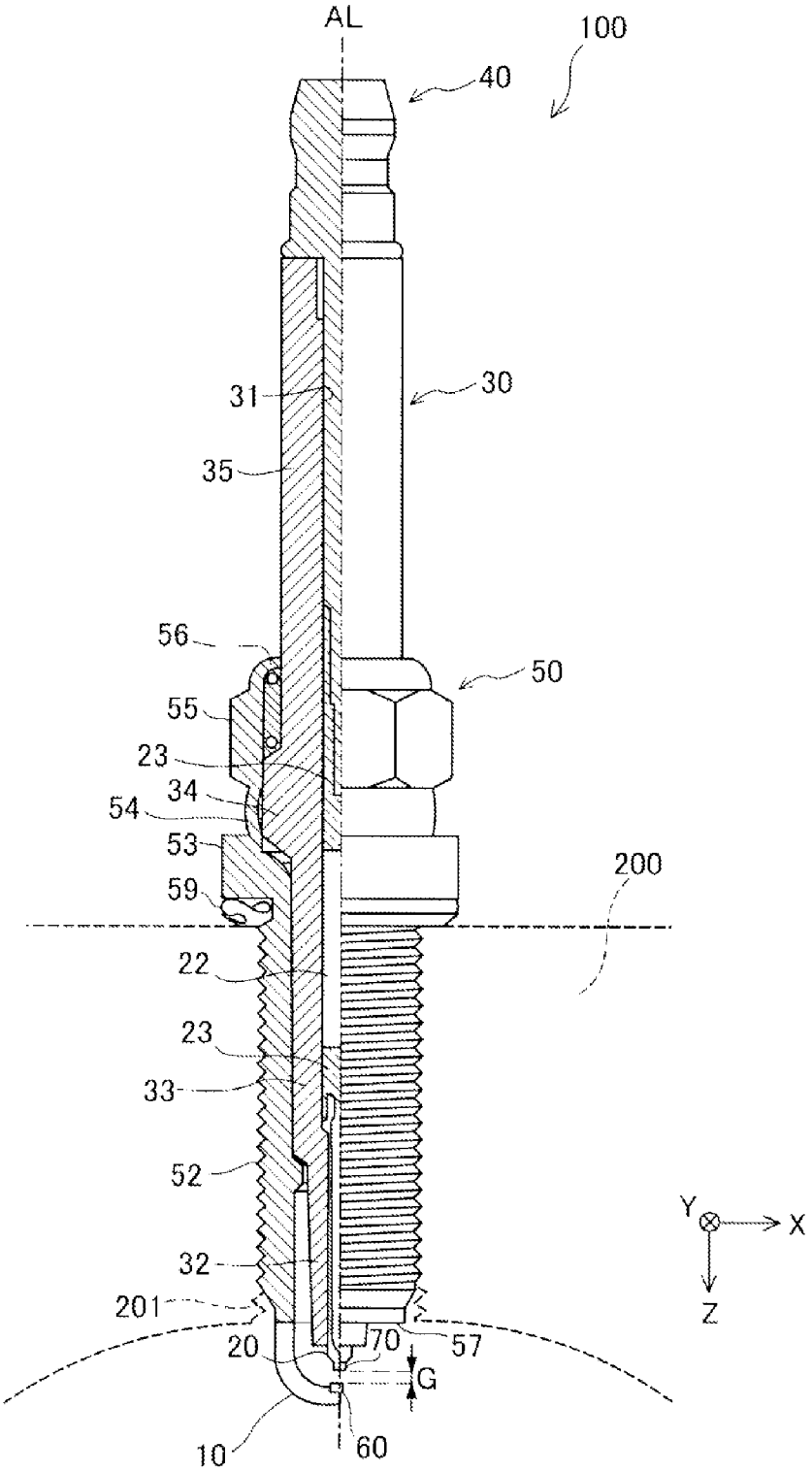
FIG. 1 is a partially sectioned view of an ignition plug which is one embodiment of the present invention.

A. First Embodiment:

FIG. 1 is a partially sectioned view of an ignition plug which is one embodiment of the present invention. In a first embodiment, the ignition plug 100 is also called "spark plug" and is used in, for example, an engine of a vehicle. In FIG. 1, an external shape of the ignition plug 100 is shown on the right side of an axial line AL, which is the center axis of the ignition plug 100, and a cross-sectional shape of the ignition plug 100 is shown on the left side of the axial line AL. In the following description, the lower side of FIG. 1 (the side of the ignition plug 100 where a ground electrode 10 to be described later is disposed) will be referred to as the "forward end side," and the upper side of FIG. 1 (the side of the ignition plug 100 where a metallic terminal 40 to be described later is disposed) will be referred to as the "rear end side."

The ignition plug 100 includes a center electrode 20, a ceramic insulator 30, the metallic terminal 40, a metallic shell 50, and the ground electrode 10. The axial line AL of the ignition plug 100 also serves as the center axes of the center electrode 20, the ceramic insulator 30, the metallic terminal 40, and the metallic shell 50.

The center electrode 20 is a rod-shaped electrode extending in a direction (axial direction) along the axial line AL. In the present embodiment, the "axial direction" encompasses both of a +Z direction and a −Z direction (hereinafter also referred to as the "Z direction"). A forward end portion of the center electrode 20 projects from the ceramic insulator 30, and the center electrode 20, excluding the forward end portion thereof, is held by the ceramic insulator 30. The center electrode 20 may be formed of a nickel alloy (e.g., Inconel (registered trademark)), which contains nickel as a main component. Also, the center electrode 20 may be formed of an alloy member having a structure in which, for example, a core member formed of copper or an alloy containing copper as a main component is embedded in a member formed of a nickel alloy. A rear end portion of the center electrode 20 is electrically connected to the metallic terminal 40 through a resistor 22 and a seal 23. Notably, the resistor 22 may be omitted.

The center electrode 20 has an electrode tip 70 at the forward end thereof. The electrode tip 70 is formed of a metal which is excellent in spark-consumption resistance and oxidation-consumption resistance. A noble metal such as platinum, iridium, ruthenium, or rhodium, or an alloy containing a noble metal may be used as the metal for electrode tip 70. The electrode tip 70 has an external shape of a circular column whose axial line coincides with the axial line AL. In the present embodiment, the electrode tip 70 forms a portion of the center electrode 20, the forward end of the center electrode 20 means the forward end of the electrode tip 70.

The ceramic insulator 30 is a tubular insulator having a through-hole 31 formed along the center axis. The other portions except for a forward end portion of the center electrode 20 are inserted into the through-hole 31. The ceramic insulator 30 may be formed by firing an insulating ceramic material such as alumina. The ceramic insulator 30 has a leg portion 32, a forward trunk portion 33, a center trunk portion 34, and a rear trunk portion 35 in this order from the forward end side toward the rear end side. The leg portion 32 is a tubular portion whose outer diameter decreases gradually from the rear end side toward the forward end side. The forward trunk portion 33 is a tubular portion which is connected to the leg portion 32 and the center trunk portion 34 and which has an outer diameter greater than that of the leg portion 32. The center trunk portion 34 is a portion which is disposed between the forward trunk portion 33 and the rear trunk portion 35 and which has an outer diameter greater than those of the forward trunk portion 33 and the rear trunk portion 35. A forward end portion of the rear trunk portion 35 is connected to a rear end portion of the center trunk portion 34, and is held by the metallic shell 50. A rear end portion of the rear trunk portion 35 is exposed. The rear trunk portion 35 is used so as to secure a sufficiently large insulating distance between the metallic shell 50 and the metallic terminal 40.

A forward end portion of the metallic terminal 40 is accommodated in the through-hole 31 of the ceramic insulator 30, and a rear end portion of the metallic terminal 40 projects from the through-hole 31. An unillustrated high-voltage cable is connected to the metallic terminal 40, and a high voltage is applied to the metallic terminal 40 as will be described later.

The metallic shell 50 is a tubular metal member into which the ceramic insulator 30 is inserted, and is formed of, for example, a metal such as low-carbon steel. The metallic shell 50 has a male screw portion 52, a seat portion 53, a buckling portion 54, a tool engagement portion 55, and a crimp portion 56. The metallic shell 50 is fixed to the ceramic insulator 30 when the metallic shell 50 is crimped at the crimp portion 56.

The male screw portion 52 has a male screw formed on the outer circumferential surface thereof, and is disposed at the forward end of the metallic shell 50. When the ignition plug 100 is attached to an engine head 200, the male screw comes into screw engagement with a female screw 201 of the engine head 200.

The seat portion 53 is a portion expanding in the radial direction, and is adjacently located on the rear end side of the male screw portion 52. An annular gasket 59 formed by folding a plate is disposed between the seat portion 53 and the engine head 200.

The buckling portion 54 has a wall thickness smaller than those of other portions of the metallic shell 50, and is disposed adjacent to the rear end of the seat portion 53. The buckling portion 54 is compressively deformed as a result of crimping at the crimp portion 56.

The tool engagement portion 55 is disposed adjacent to the rear end of the buckling portion 54. The tool engagement portion 55 has a hexagonal cross-sectional shape, for example. When the ignition plug 100 is attached to the engine head 200, a tool is engaged with the tool engagement portion 55.

Like the buckling portion 54, the crimp portion 56 has a wall thickness smaller than those of other portions of the metallic shell 50. A rear end portion of the crimp portion 56 is bent inward (toward the center axis of the metallic shell 50). The crimp portion 56 is disposed adjacent to the rear end of the tool engagement portion 55. During manufacture of the ignition plug 100, the crimp portion 56 is pressed toward the forward end side such that the crimp portion 56 is bent inward, whereby the buckling portion 54 is compressively deformed.

The ground electrode 10 is a bent rod-shaped metal member. The ground electrode 10 may have a structure similar to that of the center electrode 20. Namely, the ground electrode 10 may be configured such that a core formed of copper or an alloy containing copper as a main component is embedded in a base material formed of a nickel alloy. One end portion of the ground electrode 10 is welded to an end surface 57 of the metallic shell 50, and the ground electrode 10 is bent such that the other end thereof faces a forward end portion of the center electrode 20.

The ground electrode 10 has an electrode tip 60 at a position which faces the forward end of the center electrode 20 (the forward end of the electrode tip 70). Like the above-described electrode tip 70, the electrode tip 60 is formed of a metal which is excellent in spark-consumption resistance and oxidation-consumption resistance. In the embodiment, a gap G for spark discharge is formed between the electrode tip 60 of the ground electrode 10 and the electrode tip 70 of the center electrode 20.

The ignition plug 100 having the above-described structure is attached to the engine head 200, and forms a portion of an ignition system.

Figure 2:
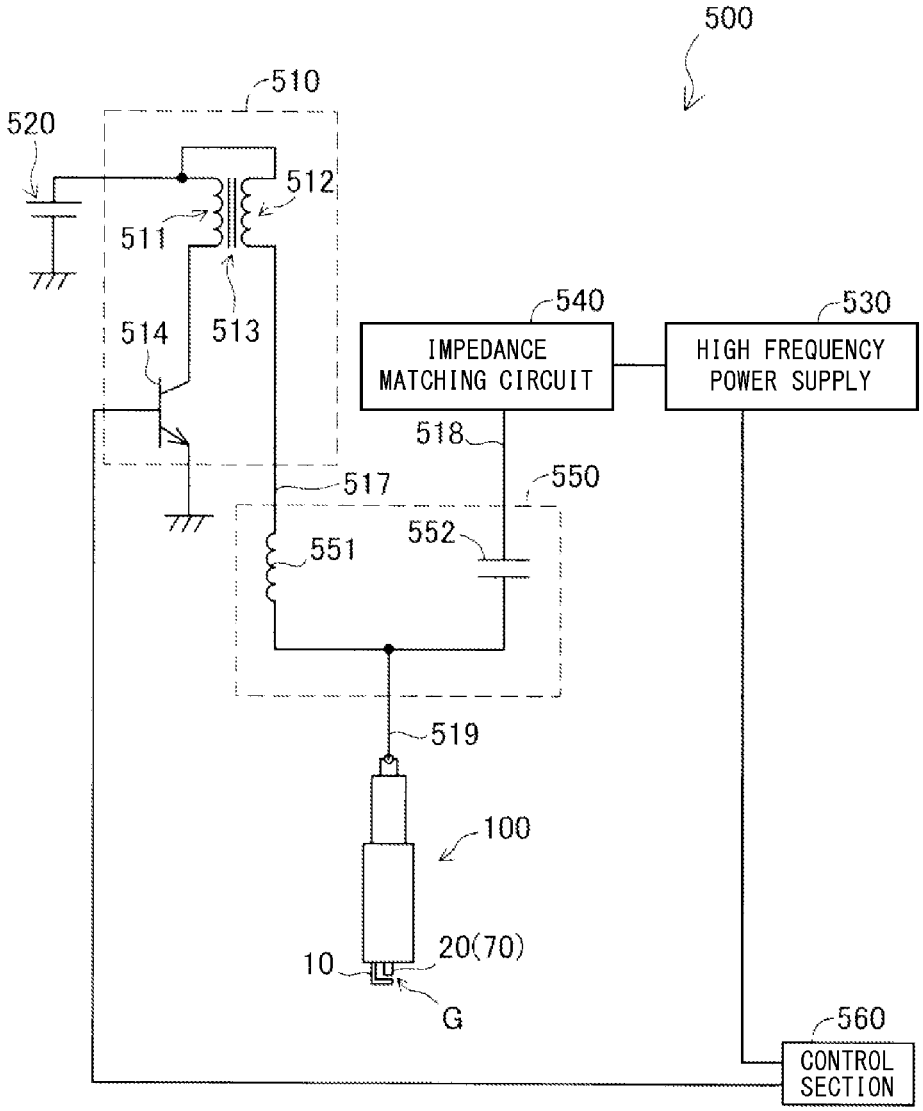
FIG. 2 is an explanatory view schematically showing the configuration of an ignition system in which an ignition plug 100 of a first embodiment is used.

FIG. 2 is an explanatory view schematically showing the configuration of the ignition system in which the ignition plug 100 of the first embodiment is used. The ignition system 500 generates plasma by applying a voltage to the ignition plug 100 and ignites an air-fuel mixture within a combustion chamber. As shown in FIG. 2, the ignition system 500 includes a discharge power supply 510, a battery 520, a high frequency power supply 530, an impedance matching circuit 540, a mixing circuit 550, and a control section 560, in addition to the ignition plug 100.

The discharge power supply 510 includes a primary coil 511, a secondary coil 512, a core 513, and an igniter 514. The primary coil 511 is a winding around the core 513. One end of the primary coil 511 is connected to the battery 520, and the other end of the primary coil 511 is connected to the igniter 514. The secondary coil 512 is another winding around the core 513. One end of the secondary coil 512 is connected to the primary coil 511 and the battery 520, and the other end of the secondary coil 512 is connected to the ignition plug 100 through the mixing circuit 550. In the first embodiment, the igniter 514 is constituted by a transistor. In response to a signal from the control section 560, the igniter 514 performs switching between a state in which electric power is supplied from the battery 520 to the primary coil 511 and a state in which the supply of electric power is stopped. When a high voltage is to be applied to the ignition plug 100, current is supplied from the battery 520 to the primary coil 511 to thereby form a magnetic field around the core 513, and the magnetic field around the core 513 is changed by changing the level of the signal output from the control section 560 from an ON level to an OFF level, whereby the secondary coil 512 generates a high voltage. As a result of the high voltage generated at the secondary coil 512 being applied to the ignition plug 100 (the center electrode 20), spark discharge (trigger discharge to be described later) is generated at the gap G.

The high frequency power supply 530 supplies a voltage having a relatively high frequency (e.g., not lower than 1 MHz and not higher than 20 MHz) to the ignition plug 100. In the first embodiment, the voltage supplied to the ignition plug 100 by the high frequency power supply 530 is an alternating voltage. Notably, the "alternating voltage" means a voltage whose magnitude and polarity (positive/negative) periodically change with time.

The impedance matching circuit 540 is connected to the high frequency power supply 530 and the mixing circuit 550. The impedance matching circuit 540 establishes matching between the output impedance of the high frequency power supply 530 and the input impedance on the side toward the mixing circuit 550 and the ignition plug 100 (i.e., the load side) when spark discharge is generated at the gap G. This prevents attenuation of the high-frequency electric power supplied to the ignition plug 100. Notably, the power transmission path extending from the high frequency power supply 530 to the ignition plug 100 may be formed by a coaxial cable so as to prevent reflection of electric power.

The mixing circuit 550 merges a transmission path 517 for the electric power output from the discharge power supply 510 and a transmission path 518 for the electric power output from the high frequency power supply 530 into a single transmission line 519 connected to the ignition plug 100. The mixing circuit 550 includes a coil 551 and a capacitor 552. The coil 551 allows the current of relatively low frequency output from the discharge power supply 510 to pass therethrough, and prevents passage of the current of relatively high frequency output from the high frequency power supply 530, to thereby prevent the current output from the high frequency power supply 530 from flowing toward the discharge power supply 510 side. The capacitor 552 allows the current of relatively high frequency output from the high frequency power supply 530 to pass therethrough, and prevents passage of the current of relatively low frequency output from the discharge power supply 510. Therefore, the current output from the discharge power supply 510 is prevented from flowing toward the high frequency power supply 530 side. Notably, the coil 551 may be omitted by using the secondary coil 512 instead of the coil 551.

The control section 560 controls the timings at which the discharge power supply 510 and the high frequency power supply 530 apply respective voltages to the ignition plug 100. The control section 560 may be formed by, for example, an ECU (Electronic Control Unit) including a CPU (Central Processing Unit) and a memory.

Figure 3:
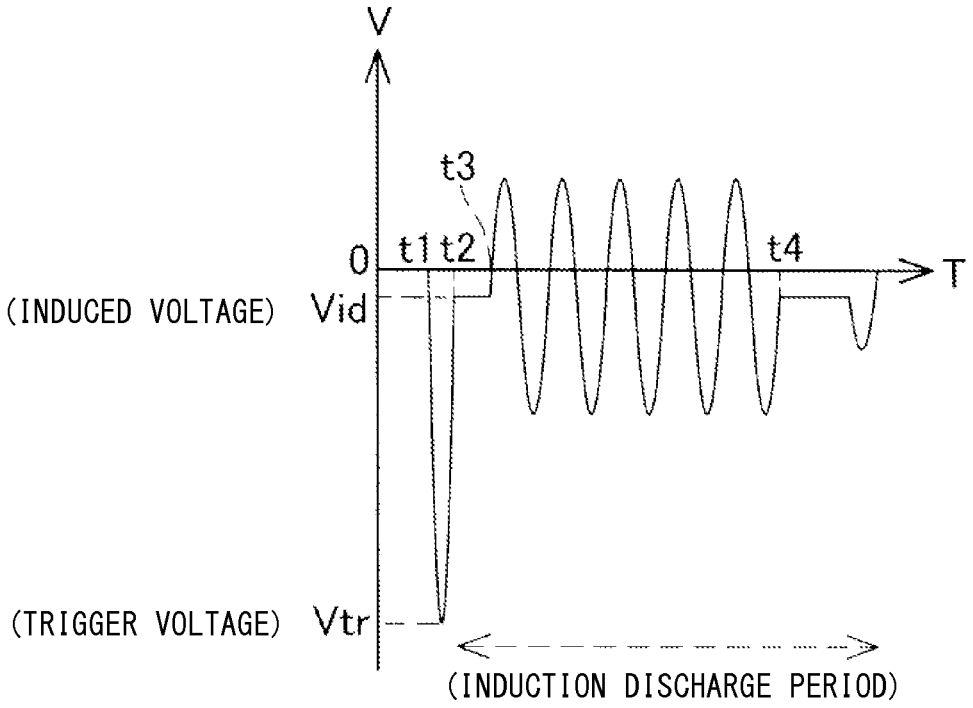
FIG. 3 is a timing chart showing an example of a voltage applied to the ignition plug 100 in the first embodiment.

FIG. 3 is a timing chart showing an example of the voltage applied to the ignition plug 100 in the first embodiment. In FIG. 3, the horizontal axis represents time T, and the vertical axis represents the voltage applied to the center electrode 20. As shown in FIG. 3, a high voltage (e.g., 5 kV to 30 kV) of negative polarity is supplied from the discharge power supply 510 to the ignition plug 100 during a relatively short period from time t1 to time t2, whereby spark discharge is generated at the gap G. As will be described later, the spark discharge is discharge which serves as a base for plasma (hereinafter referred to as "trigger discharge"). Notably, in the following description, the applied voltage for generating the trigger discharge will be referred to as a "trigger voltage." After application of the trigger voltage, an induced voltage Vid (e.g., 0.5 kV) generated in the secondary coil 512 and the coil 551 is supplied to the ignition plug 100 during a relatively short period from time t2 to time t3. Next, during a period from time t3 to time t4, a voltage is applied from the high frequency power supply 530 to the ignition plug 100.

Since the high frequency power supply 530 supplies an alternating voltage to the ignition plug 100 as described above, as shown in FIG. 3, the applied voltage includes a plurality of peak voltages. Specifically, a negative voltage corresponding to a minimum point at which the trend of voltage change switches from a decrease trend to an increase trend, and a positive voltage corresponding to a maximum point at which the trend of voltage change switches from an increase trend to a decrease trend are applied alternatingly and repeatedly. As described above, by applying a voltage including a plurality of peak voltages; in other words, by periodically changing the trend of voltage change, it is possible to generate plasma on the basis of the discharge generated upon application of the trigger voltage, and to grow the plasma. The mechanism of this phenomenon is as follows. Due to the spark discharge generated upon application of the trigger voltage, ions and radicals are produced in the vicinity of the gap G. Since the ions and radicals vibrate while receiving the influence of an electric field produced by the applied voltage including a plurality of peak voltages, the frequency at which the ions and radicals collide with water molecules and nitrogen molecules existing therearound increases greatly. Therefore, an ionized gas; i.e., plasma, is generated around the gap G, and the plasma grows gradually. Due to the plasma grown in this manner, a flame originating from the spark discharge generated upon application of the trigger voltage gradually becomes large, whereby its performance of igniting an air-fuel mixture within a combustion chamber is enhanced. Notably, as shown in FIG. 3, the alternating voltage applied from time t3 to time t4 is such that the center value of the voltage coincides with the induced voltage Vid, and the amplitude is approximately constant. The above-described phrase "the amplitude is approximately constant" has a broad meaning which encompasses not only a structure in which the local maximum voltage and the local minimum voltage in a period are equal to those in another period, but also a structure in which the voltage difference (absolute value) between the local maximum voltage and the local minimum voltage in each period is between a value which is 30% smaller than the maximum value of the voltage difference throughout all the periods and a value which is 30% greater than the minimum value of the voltage difference throughout all the periods.

Figure 4:
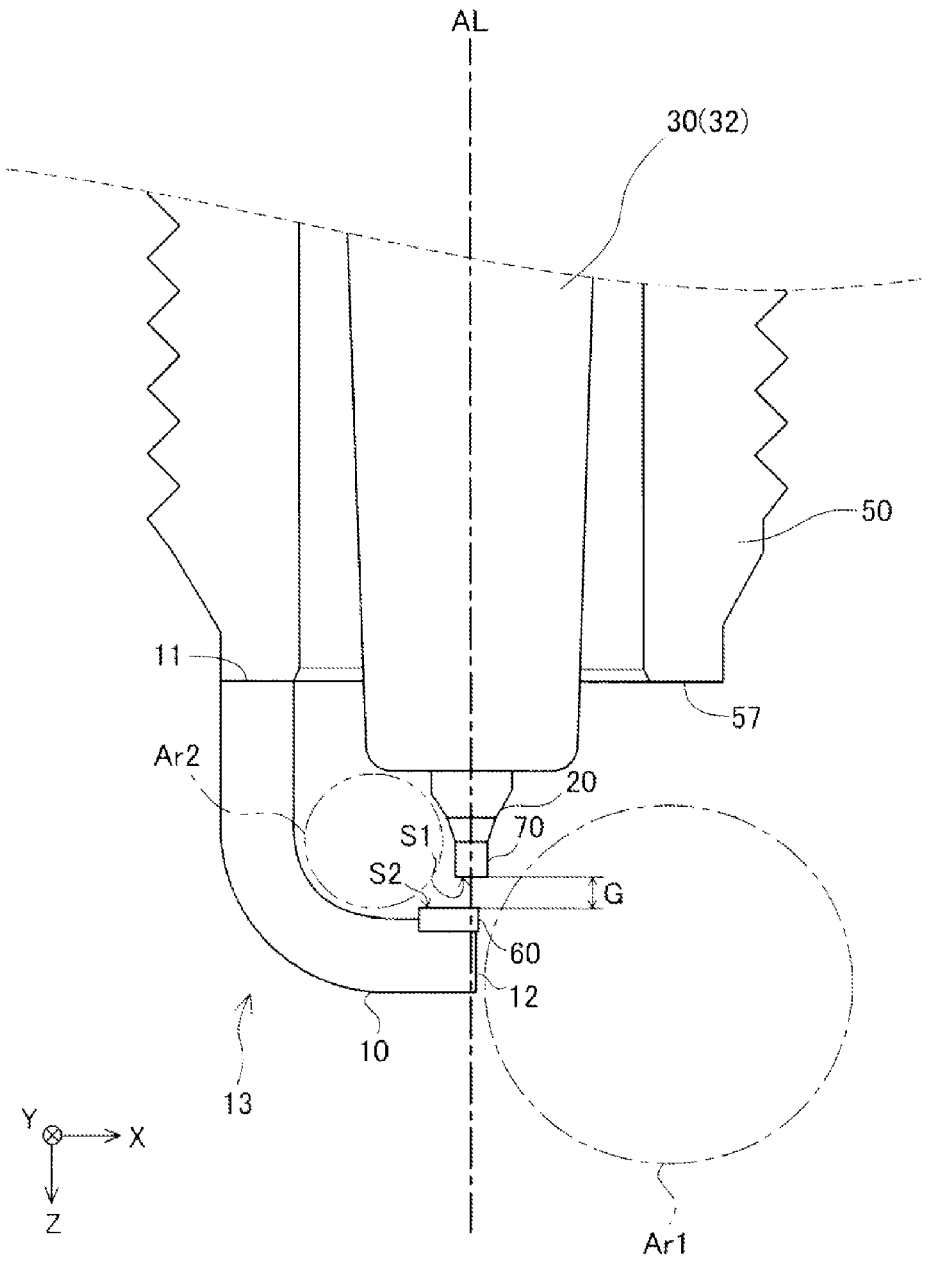
FIG. 4 is an explanatory view showing, on an enlarged scale, a forward end portion of the ignition plug 100.

FIG. 4 is an explanatory view showing, on an enlarged scale, a forward end portion of the ignition plug 100. As shown in FIG. 4, one end 11 of the ground electrode 10 is joined to an end surface 57, and the other end 12 is free end. The ground electrode 10 has a bent portion 13 formed between the one end 11 and the other end 12.

The electrode tip 70 has an external shape of a circular column whose axial line coincides with the axial line AL. In the first embodiment, an end surface of the electrode tip 70 on the forward end side (hereinafter referred to as the "forward end surface S1") is a smooth flat surface having a circular shape in planar view.

The electrode tip 60 constitutes a portion of the ground electrode 10. In other words, the ground electrode 10 is composed of a base member and the electrode tip 60 joined to the base member. A +X-side edge portion of the electrode tip 60 projects toward the +X direction side beyond the other end 12 of the ground electrode 10.

In the ground electrode 10, the electrode tip 60 is joined to the base member on the other end 12 side in the direction from the bent portion 13 toward the other end 12. Notably, the electrode tip 60 has a rectangular parallelepiped external shape. The length of the electrode tip 60 in the Y-axis direction is smaller than the length of the base member in the Y-axis direction. The electrode tip 60 has a facing end surface S2 which faces the forward end surface S1 of the electrode tip 70. In the first embodiment, each of the forward end surface S1 and the facing end surface S2 is a surface parallel to an XY plane, and the lengths of the gap G in the Z-axis direction measured at two arbitrary positions along the X-axis direction or the Y-axis direction are equal to each other. In other words, the distance between the forward end surface S1 and the facing end surface S2 in the Z-axis direction measured at two arbitrary positions are equal to each other.

As shown in FIG. 4, a space Ar2 located on one side of the gap G toward the −X direction (the direction from the other end 12 toward the bent portion 13) is small because of presence of the bent portion 13 of the ground electrode 10. Accordingly, in the case where plasma is grown in the space Ar2, the plasma cannot be grown greatly because a growable space is narrowed by presence of the ground electrode 10 and heat is taken by the ground electrode 10. In contrast, a space Ar1 located on the other side of the gap G toward the +X direction (the direction from the bent portion 13 toward the other end 12) and located on the downward side of the gap G (the downward direction coincides with the direction from the forward end surface S1 toward the facing end surface S2) is large because of absence of the bent portion 13 of the ground electrode 10. Accordingly, in the case where plasma is grown in the space Ar1, the plasma can be grown greatly. In view of this, in the ignition plug 100 of the first embodiment, the generation ratio of spark discharge (trigger discharge) is increased at a position closer to the space Ar1 than the space Ar2, whereby plasma is grown in the space Ar1.

Figure 5:
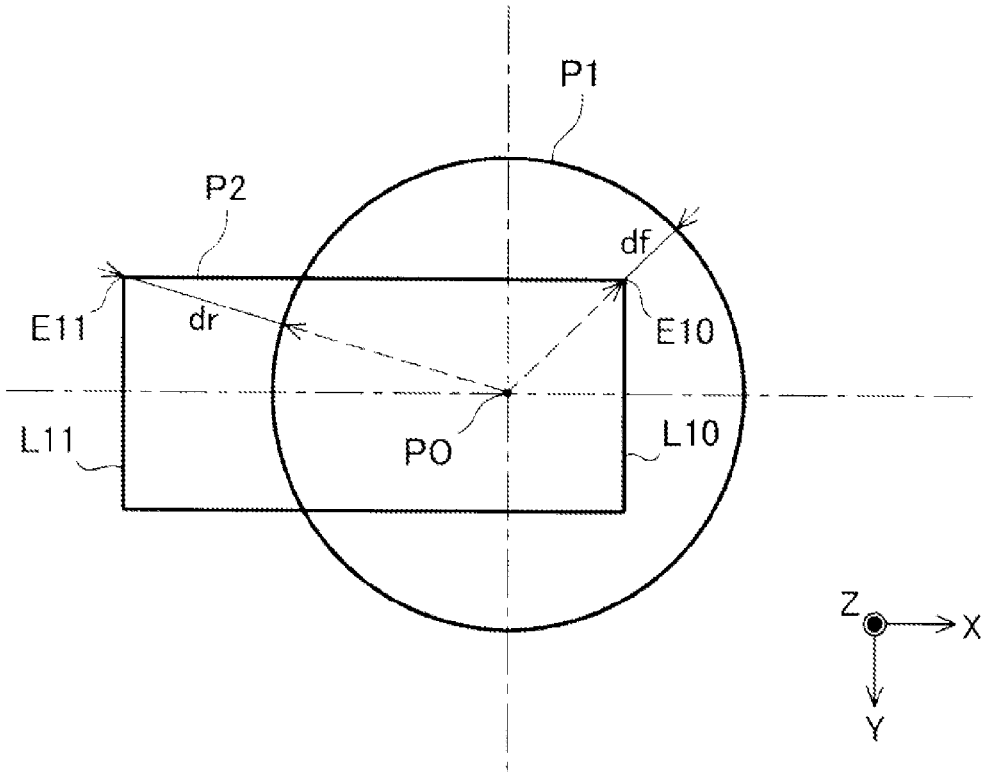
FIG. 5 is an explanatory view showing projection, onto a plane orthogonal to an axial direction, a forward end surface S1 and a facing end surface S2 shown in FIG. 4.

FIG. 5 is an explanatory view showing projection, onto a plane orthogonal to the axial direction, the forward end surface S1 and the facing end surface S2 shown in FIG. 4. As shown in FIG. 5, the shape of the projection P1 of the forward end surface S1 is circular. Also, the shape of the facing end surface S2 is the shape of a rectangle whose longitudinal direction coincides with the X-axis direction and whose lateral direction coincides with the Y-axis direction. When a forward end portion of the ignition plug 100 shown in FIG. 4 is viewed in the −Z direction, the forward end surface S1 and the facing end surface S2 overlap with each other. Therefore, as shown in FIG. 5, the projection P1 of the forward end surface S1 and the projection P2 of the facing end surface S2 overlap with each other.

As shown in FIG. 5, the projection P0 of the center of the forward end surface S1 and the projection P2 of the facing end surface S2 overlap with each other. Also, the projection L10 of an edge portion among the edge portions of the facing end surface S2 which is located on the side remote from the bent portion 13 (hereinafter referred to as the "remote-side edge portion") is located within the projection P1 of the forward end surface S1. Notably, in the first embodiment, the projection L10 of the remote-side edge portion refers to the projection of a short side of the facing end surface S2 which is located on the other end 12 side in the direction from the bent portion 13 toward the other end 12.

Also, as shown in FIG. 5, the distance df between the projection L10 of the remote-side edge portion and the circumference of the projection P1 of the forward end surface S1 is smaller than the distance dr between the projection L11 of the near-side edge portion and the circumference of the projection P1 of the forward end surface S1. The "near-side edge portion" means an edge portion among the edge portions of the facing end surface S2 which is located on the side toward (near) the bent portion 13. Specifically, the projection L11 is a projection of a short side of the facing end surface S2, which side is located on the bent portion 13 side in the direction from the other end 12 toward the bent portion 13. As shown in FIG. 5, the distance df is the distance between the circumference of the projection P1 of the forward end surface S1 and the projection of an end point E10 of the remote-side edge portion, which projection is a portion of the projection L10. Also, the distance dr is the distance between the circumference of the projection P1 of the forward end surface S1 and the projection of an end point E11 of the near-side edge portion, which projection is a portion of the projection L10. Notably, in the first embodiment, the distances along the Z axis between the forward end surface S1 and the facing end surface S2 measured at two arbitrary points are equal to each other as described above. Therefore, the distance (the distance in the three-dimension space) between the remote-side edge portion and the circumference of the forward end surface S1 is smaller than the distance (the distance in the three-dimension space) between the near-side edge portion and the circumference of the forward end surface S1.

In the first embodiment, by disposing the forward end surface S1 (the electrode tip 70) and the facing end surface S2 (the electrode tip 60) such that the projection P1 of the forward end surface S1 and the projection P2 of the facing end surface S2 satisfy the above-mentioned positional relation, plasma is rendered more likely to generate at a position closer to the space Ar1 than the space Ar2, and spark-consumption resistance is improved.

Specifically, since the forward end surface S1 and the facing end surface S2 are disposed such that the projection L10 of the remote-side edge portion is located within the projection P1 of the forward end surface S1, a portion corresponding to the projection L10 (a +X side end portion of the facing end surface S2) can be utilized for spark discharge generated upon application of a trigger voltage. In addition, since the distance df between the projection L10 of the remote-side edge portion and the circumference of the projection P1 of the forward end surface S1 becomes smaller than the distance dr between the projection L11 of the near-side edge portion and the circumference of the projection P1 of the forward end surface S1, a portion corresponding to the projection L10 can be utilized for spark discharge at a higher ratio as compared with a portion corresponding to the projection L11. Therefore, spark discharge can be generated at a position closer to the space Ar1, whereby plasma becomes more likely to generate in the space Ar1.

Also, since the forward end surface S1 and the facing end surface S2 are disposed such that the projection P0 of the center of the forward end surface S1 overlaps with the projection P2 of the facing end surface S2, in the electrode tip 60, not only the facing end surface S2 but also the other end 12 and side surfaces adjacent to the facing end surface S2 and the other end 12 can be utilized for spark discharge. Therefore, as compared with, for example, a structure in which only the facing end surface S2 is utilized for spark discharge, local consumption of the facing end surface S2 can be suppressed, and the expansion of the gap G between the center electrode 20 and the ground electrode 10 can be delayed. Accordingly, the overall spark-consumption resistance of the ignition plug 100 can be enhanced.

Figure 6:
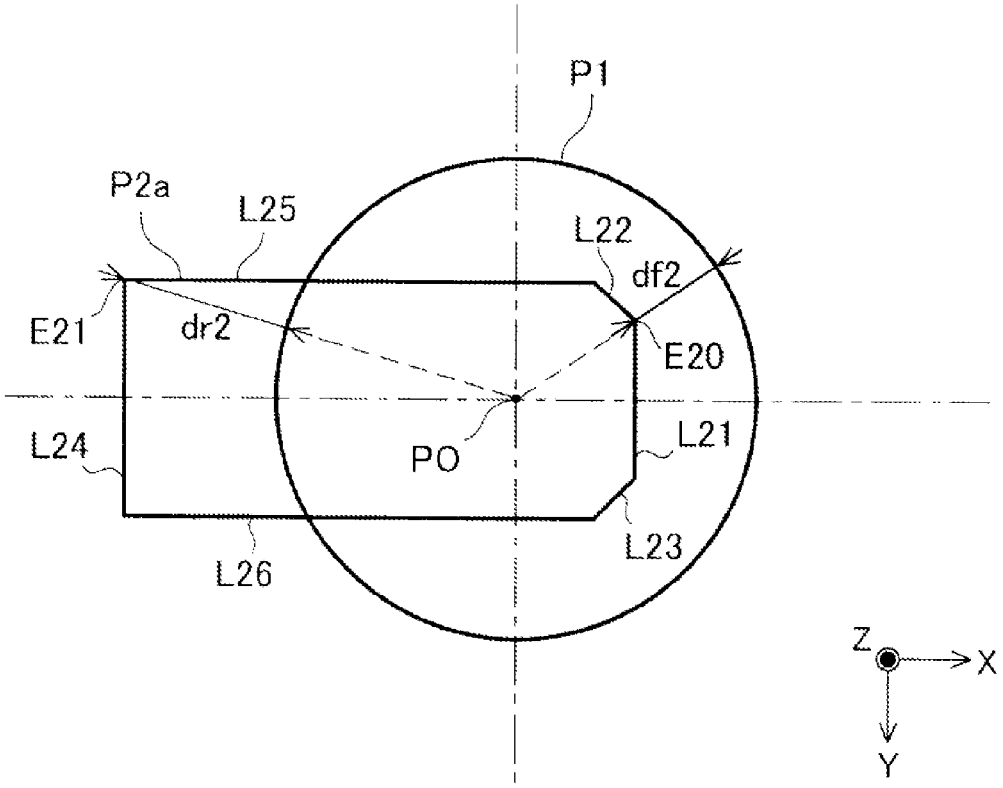
FIG. 6 is an explanatory view showing projection of the forward end surface and the facing end surface onto the plane orthogonal to the axial direction in a second embodiment.

B. Second Embodiment:

FIG. 6 is an explanatory view showing projection of the forward end surface and the facing end surface onto the plane orthogonal to the axial direction in an ignition plug of a second embodiment. The ignition plug of the second embodiment is identical with the ignition plug 100 of the first embodiment except that the shape of the projection of the facing end surface (the electrode tip) is hexagonal.

As shown in FIG. 6, the projection P2*a* of the facing end surface in the second embodiment has a hexagonal peripheral shape (contour). Specifically, the projection P2*a* has a short side L24 located at the −X direction side end of the projection P2*a* and extending along the Y-axis direction, a short side L21 located at the +X direction side end of the projection P2*a* and extending along the Y-axis direction, a long side L25 located at the −Y direction side end of the projection P2*a* and extending along the X-axis direction, a long side L26 located at the +Y direction side end of the projection P2*a* and extending along the X-axis direction, an oblique side L22 connecting the short side L21 and the long side L25, and an oblique side L23 connecting the short side L21 and the long side L26.

In the second embodiment, the short side L21 is located at the end of the projection P2*a* on the other end 12 side in the direction from the bent portion 13 toward the other end 12. In the second embodiment, the short side L21 corresponds to the remote-side edge portion in the claims. Also, the short side L24 is located at the end of the projection P2*a* on the bent portion 13 side in the direction from the other end 12 toward the bent portion 13. In the second embodiment, the short side L24 corresponds to the near-side edge portion in the claims.

In the second embodiment, the distance df2 between the remote-side edge portion (the short side L21) and the circumference of the forward end surface S1 is smaller than the distance dr2between the near-side edge portion (the short side L24) and the circumference of the forward end surface S1. Notably, as shown in FIG. 6, the distance df2 means the distance between the circumference of the projection P1 and the intersection (edge) E20 between the short side L21 and the oblique side L22. Also, the distance dr2 means the distance between the circumference of the projection P1 and the intersection (edge) E21 between the short side L24 and the long side L25.

The ignition plug of the second embodiment having the above-described structure have effects similar to those of the ignition plug 100 of the first embodiment.

Figure 7:
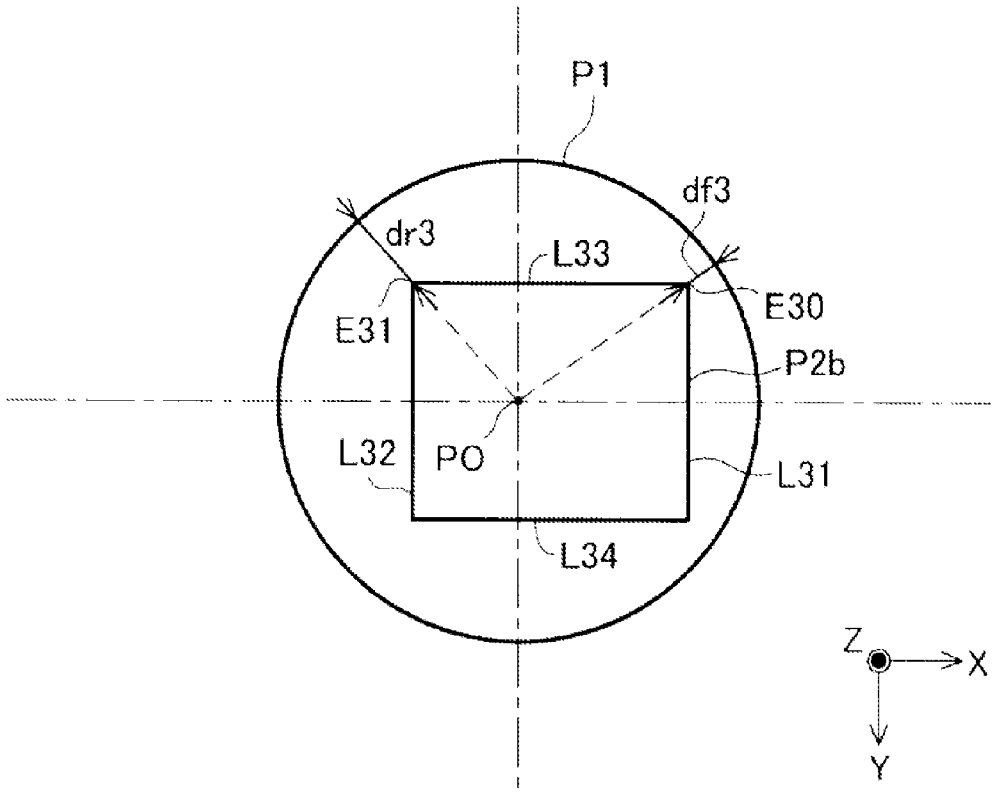
FIG. 7 is an explanatory view showing projection of the forward end surface and the facing end surface onto the plane orthogonal to the axial direction in a third embodiment.

C. Third Embodiment:

FIG. 7 is an explanatory view showing projection of the forward end surface and the facing end surface onto the plane orthogonal to the axial direction in an ignition plug of a third embodiment. The ignition plug of the third embodiment is identical with the ignition plug 100 of the first embodiment except that the entirety of the projection of the facing end surface (the electrode tip) is located within the projection of the forward end surface S1.

As shown in FIG. 7, like the projection P2 in the first embodiment, the projection P2*b* of the facing end surface in the third embodiment has a rectangular peripheral shape (contour). Specifically, the projection P2*b* of the facing end surface has a short side L31 located at the +X direction side end of the projection P2*b* and extending along the Y-axis direction, a short side L32 located at the −X direction side end of the projection P2*b* and extending along the Y-axis direction, a long side L33 located at the −Y direction side end of the projection P2*b* and extending along the X-axis direction, and a long side L34 located at the +Y direction side end of the projection P2*b* and extending along the X-axis direction.

In the third embodiment, the short side L31 is located at the end of the projection P2*b* on the other end 12 side in the direction from the bent portion 13 toward the other end 12. In the third embodiment, the short side L31 corresponds to the remote-side edge portion in the claims. Also, the short side L32 is located at the end of the projection P2*b* on the bent portion 13 side in the direction from the other end 12 toward the bent portion 13. In the third embodiment, the short side L32 corresponds to the near-side edge portion in the claims.

In the third embodiment, the distance df3 between the remote-side edge portion (the short side L31) and the circumference of the forward end surface S1 is smaller than the distance dr3 between the near-side edge portion (the short side L32) and the circumference of the forward end surface S1. Notably, as shown in FIG. 7, the distance df3 means the distance between the circumference of the projection P1 and the intersection (edge) E30 between the short side L31 and the long side L33. Also, the distance dr3 means the distance between the circumference of the projection P1 and the intersection (edge) E31 between the short side L32 and the long side L33.

In the third embodiment, unlike the first embodiment, the short side L32 is located within the projection P1. However, since the distance df3 between the remote-side edge portion (the short side L31) and the circumference of the forward end surface S1 is smaller than the distance dr3 between the near-side edge portion (the short side L32) and the circumference of the forward end surface S1, spark discharge is likely to generate by using the short side L31 more as compared with the short side L32. Accordingly, as in the case of the ignition plug 100 of the first embodiment, since spark discharge can be generated at a position closer to the space Ar1 than the space Ar2, generation and growth of plasma can be readily promoted in the space Ar1.

The ignition plug of the third embodiment having the above-described structure have effects similar to those of the ignition plug 100 of the first embodiment.

Figure 8:
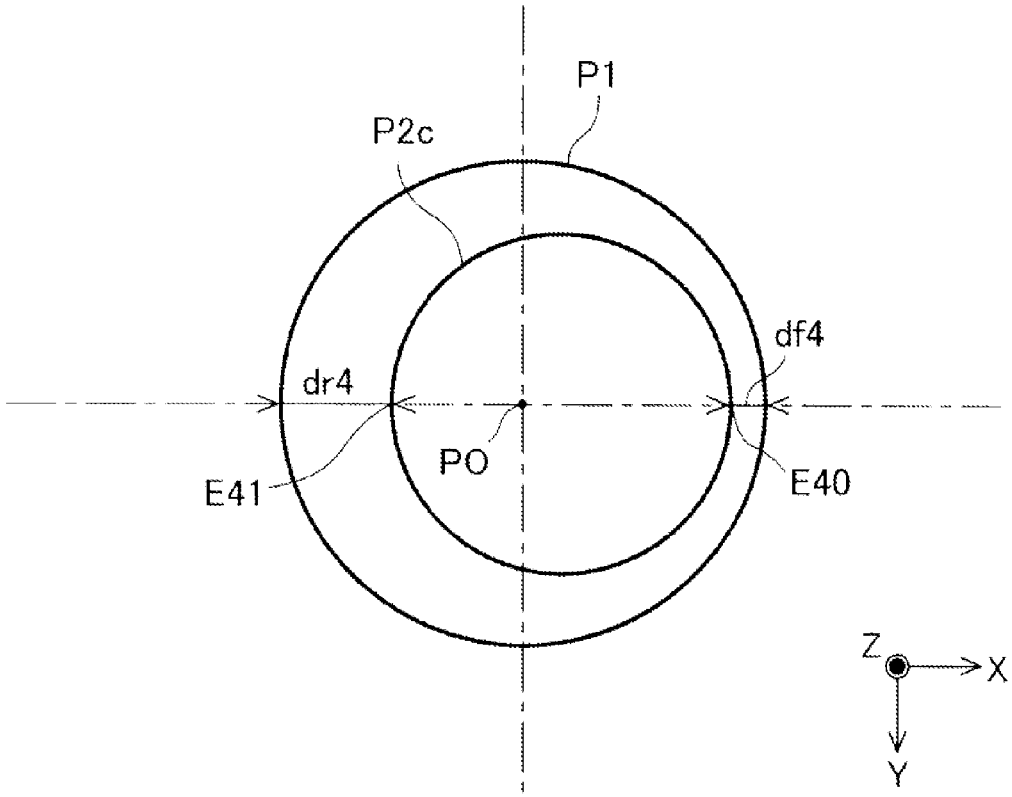
FIG. 8 is an explanatory view showing projection of the forward end surface and the facing end surface onto the plane orthogonal to the axial direction in a fourth embodiment.

D. Fourth Embodiment:

FIG. 8 is an explanatory view showing projection of the forward end surface and the facing end surface onto the plane orthogonal to the axial direction in an ignition plug of a fourth embodiment. The ignition plug of the fourth embodiment is identical with the ignition plug 100 of the first embodiment except that the shape of the facing end surface S2 is circular, the entirety of the projection of the facing end surface (the electrode tip) is located within the projection of the forward end surface S1, and the +X direction side end of the electrode tip is located on the −X direction side in relation to the other end 12 of the ground electrode 10.

As shown in FIG. 8, the projection P2*c* of the facing end surface in the fourth embodiment has a circular peripheral shape (contour). In the fourth embodiment as well, the projection P0 of the center of the forward end surface S1 and the projection P2*c* of the facing end surface overlap with each other as in the first embodiment. Also, in the projection P2*c*, a +X direction side end portion (end point) E40 is located within the projection P1 of the forward end surface S1. Also, in the projection P2*c*, a −X direction side end portion (end point) E41 is located within the projection P1 of the forward end surface S1. Notably, in the fourth embodiment, the end point E40, the projection P0, and the end point E41 are disposed on a common straight line. In the fourth embodiment, the end point E40 corresponds to the remote-side edge portion in the claims. Also, the end point E41 corresponds to the near-side edge portion in the claim. In the fourth embodiment, the distance df4 between the remote-side edge portion (the end point E40) and the circumference of the forward end surface S1 is smaller than the distance dr4 between the near-side edge portion (the end point E41) and the circumference of the forward end surface S1.

Figure 9:
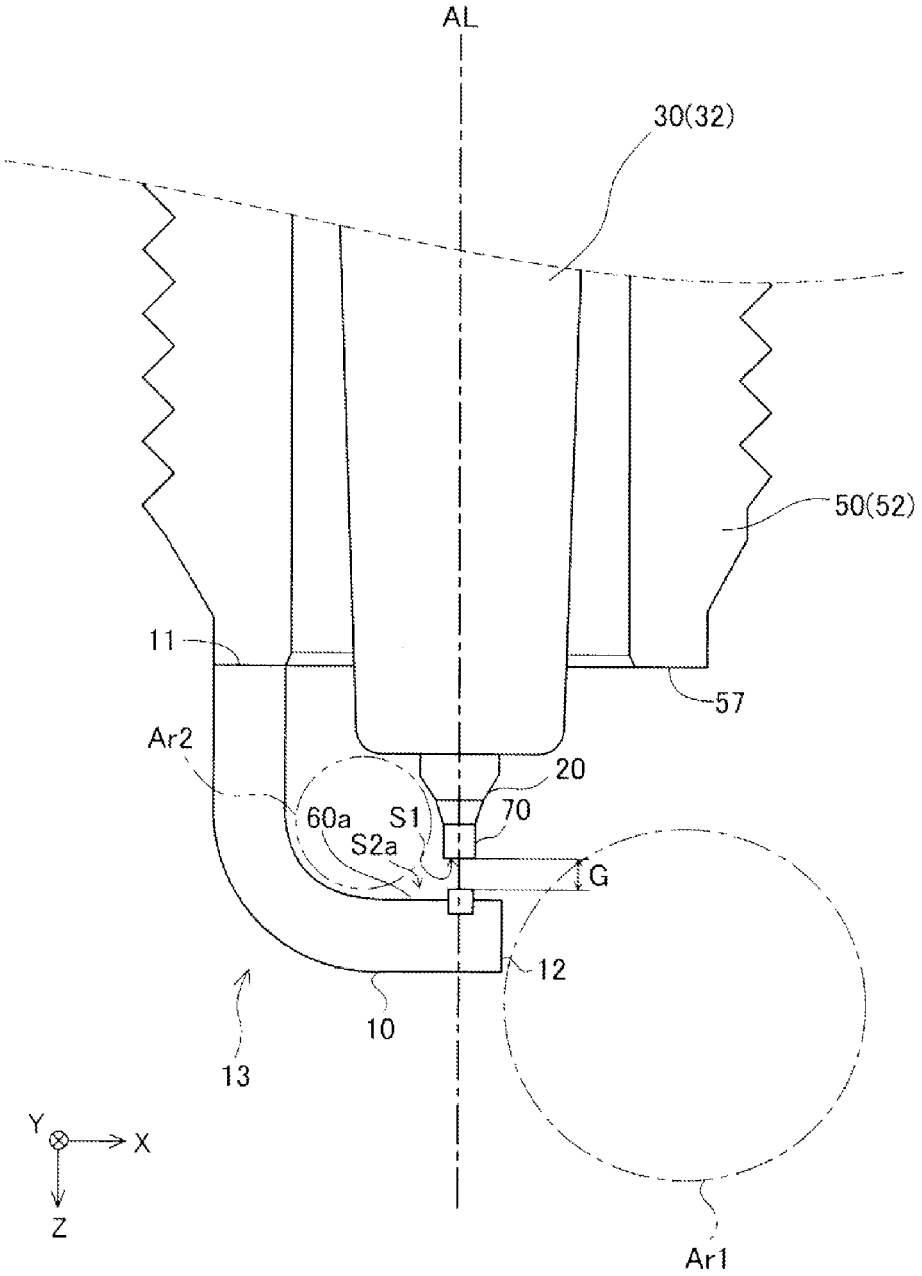
FIG. 9 is an explanatory view showing, on an enlarged scale, a forward end portion of the ignition plug of the fourth embodiment.

FIG. 9 is an explanatory view showing, on an enlarged scale, a forward end portion of the ignition plug of the fourth embodiment. As shown in FIG. 9, the ignition plug of the fourth embodiment has an electrode tip 60*a*. The electrode tip 60*a* differs from the electrode tip 60 in the first embodiment shown in FIG. 4 in terms of the relative position in relation to the ground electrode 10. Specifically, the electrode tip 60*a* of the fourth embodiment is disposed such that its +X direction side end is located on the −X-direction side of the other end 12 of the ground electrode 10.

As shown in FIG. 8, in the fourth embodiment, the entirety of the projection P2*c* of the facing end surface is located within the projection P1 of the forward end surface S1 unlike the first embodiment. However, since the distance df4 between the remote-side edge portion (the end point E40) and the circumference of the forward end surface S1 is smaller than the distance dr4 between the near-side edge portion (the end point E41) and the circumference of the forward end surface S1, spark discharge is likely to generate by using the end point E40 more as compared with the end point E41. Accordingly, as in the case of the ignition plug 100 of the first embodiment, since spark discharge can be generated at a position closer to the space Ar1 than the space Ar2, generation and growth of plasma can be readily promoted in the space Ar1.

The ignition plug of the fourth embodiment having the above-described structure have effects similar to those of the ignition plug 100 of the first embodiment.

E. Examples:

E1. First Example:

In addition to a sample (sample s1) of the above-described first embodiment, samples of three comparative examples (sample s2 of Comparative Example 1, sample s3 of Comparative Example 2, and sample s4 of Comparative Example 3) were manufactured.

In the sample s1, the diameter of the forward end surface S1 (the electrode tip 70) was 1.2 mm. Also, the length of the facing end surface S2 in the lateral direction (Y-axis direction) was 0.7 mm, and the length of the facing end surface S2 in the longitudinal direction (X-axis direction) was 1.7 mm.

Figure 10:
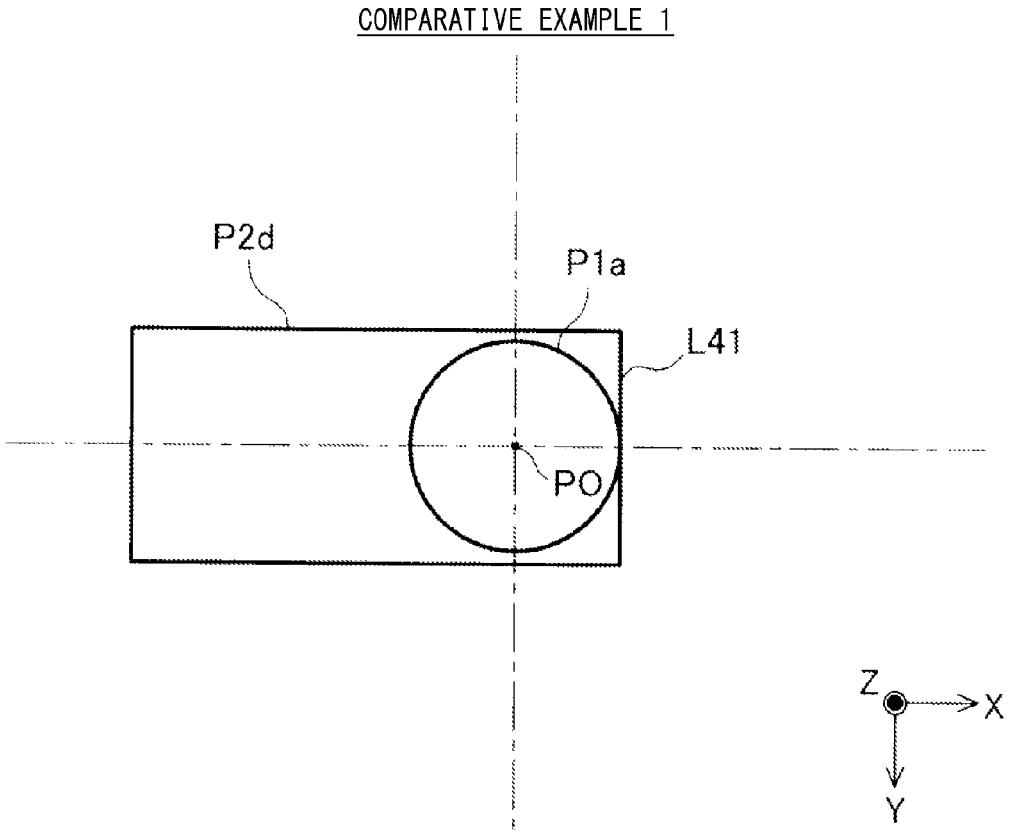
FIG. 10 is an explanatory view showing projection of the forward end surface and the facing end surface onto the plane orthogonal to the axial direction in Comparative Example 1 (sample s2).

FIG. 10 is an explanatory view showing projection of the forward end surface and the facing end surface onto the plane orthogonal to the axial direction in Comparative Example 1 (sample s2). The sample s2 of Comparative Example 1 differs from the ignition plug 100 (sample s1) of the first embodiment in terms of the size of the forward end surface (the electrode tip provided on the center electrode). The remaining structure is identical with that of the ignition plug 100 (sample s1) of the first embodiment.

The diameter of the forward end surface of the sample s2 of Comparative Example 1 is smaller than the diameter of the forward end surface S1 of the ignition plug 100 of the first embodiment. Meanwhile the shape and size of the facing end surface of the sample s2 are identical to those of the facing end surface S2 of the ignition plug 100 of the first embodiment. Therefore, as shown in FIG. 10, the projection P2*d* of the facing end surface of Comparative Example 1 is larger than the projection P1*a* of the forward end surface. Therefore, the projection L41 of a remote-side edge portion of the facing end surface of Comparative Example 1 is located outside the projection of the forward end surface.

In the sample s2, the diameter of the forward end surface (the electrode tip provided on the center electrode) was 0.5 mm. Also, the length of the facing end surface in the lateral direction (Y-axis direction) was 0.7 mm, and the length of the facing end surface in the longitudinal direction (X-axis direction) was 1.7 mm.

Figure 11:
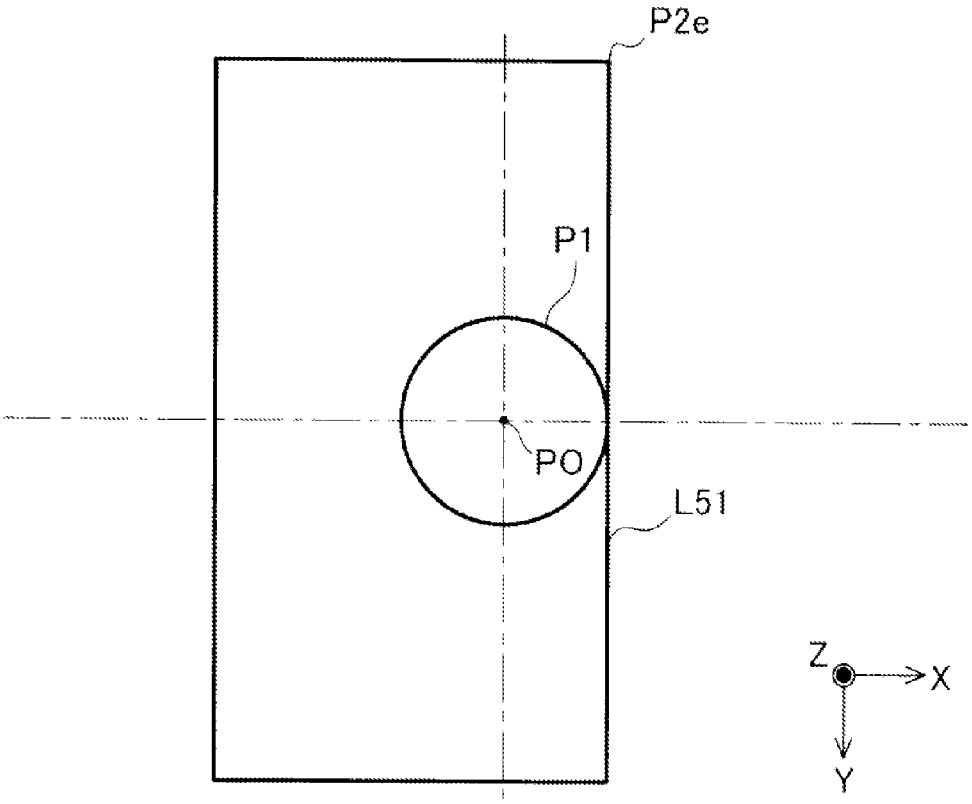
FIG. 11 is an explanatory view showing projection of the forward end surface and the facing end surface onto the plane orthogonal to the axial direction in Comparative Example 2 (sample s3).

FIG. 11 is an explanatory view showing projection of the forward end surface and the facing end surface onto the plane orthogonal to the axial direction in Comparative Example 2 (sample s3). The sample s3 of Comparative Example 2 differs from the ignition plug 100 (sample s1) of the first embodiment in terms of the size of the forward end surface (the electrode tip provided on the center electrode) and the shape and size of the facing end surface. The remaining structure is identical to that of the ignition plug 100 (sample s1) of the first embodiment.

The diameter of the forward end surface of the sample s3 of Comparative Example 2 is smaller than the diameter of the forward end surface S1 of the ignition plug 100 of the first embodiment. Meanwhile the shape of the facing end surface of the sample s3 differs from that of the facing end surface S2 in the first embodiment; i.e., the longitudinal direction of the facing end surface of the sample s3 corresponding to the Y-axis direction, and the lateral direction of the facing end surface of the sample s3 corresponding to the X-axis direction. Also, the lengths of the facing end surface in the Y-axis and X-axis directions are greater than the diameter of the forward end surface. Therefore, the projection L51 of a portion (remote-side edge portion) of the edge of the facing end surface of Comparative Example 2, which portion is located on the side remote from the bent portion, is located outside the projection of the forward end surface.

In the sample s3, the diameter of the forward end surface (the electrode tip provided on the center electrode) was 0.5 mm. Also, the length of the facing end surface in the longitudinal direction (Y-axis direction) was 2.5 mm, and the length of the facing end surface in the lateral direction (X-axis direction) was 1.0 mm.

The structure (shape) of a sample s4 is identical to the structure of the sample s1. However, as will be described later, the manner of application of voltage to the sample s4 differs from the manner of application of voltage to the sample s1.

A plasma expansion evaluation test was carried out by using the four samples s1 to s4 manufactured as described above. Specifically, each of the samples s1 to s4 was attached to a combustion chamber for test (a chamber imitating a combustion chamber), each of the samples s1 to s4 was caused to generate spark, and an image of the gap G and an area therearound after elapse of 1 ms (millisecond) was captured by Schlieren photography. Next, the extension (size) of plasma in a region corresponding to the space Ar1 was evaluated by counting the number of pixels corresponding to the plasma within the captured image. Namely, the greater the number of pixels corresponding to the plasma, the greater the size to which the plasma was evaluated to have grown. Notably, at the time of the test, the combustion chamber was filled with propane and air, and the internal pressure of the combustion chamber was set to 0.05 MPa.

Notably, when the samples s1 and s3 were tested, each of the samples s1 and s3 was incorporated into the ignition system 500, an alternating voltage of 13 MHz was applied to each sample as an application voltage after trigger discharge, and a current whose maximum value was 5 A was supplied to each sample for 1 ms. When the samples s2 and s4 were tested, each of the samples s2 and s4 was incorporated into the ignition system 500, and only a trigger voltage was applied to each sample without application of an alternating voltage including a plurality of peak voltages.

Figure 12:
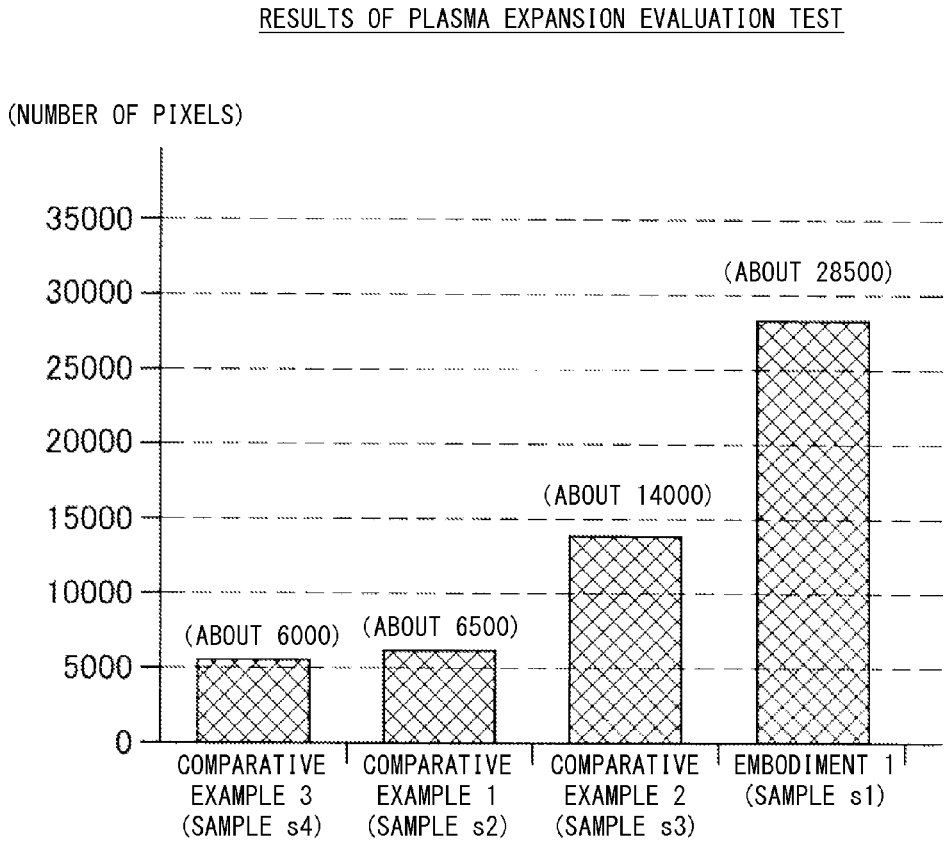
FIG. 12 is an explanatory view showing the results of a plasma expansion evaluation test in a first example.

FIG. 12 is an explanatory view showing the results of the plasma expansion evaluation test in the first example. As shown in FIG. 12, the number of pixels corresponding to the plasma was the smallest in the sample s4 (about 6000), was the second smallest in the sample s2 (about 6500), was the third smallest in the sample s3 (about 14000), and the number of pixels corresponding to the plasma was the largest in the sample s1 (about 28500). These results show that, when the sample s1 of the first embodiment was used, plasma grew to a larger size in the space Ar1, as compared with the case where the sample s2 of Comparative Example 1 or the sample s3 of Comparative Example 2 was used. In addition, comparison between the test results of the sample s1 and the test results of the sample s4 reveals that plasma was able to be grown to a greater size by applying an alternating voltage including a plurality of peak voltages after application of a trigger voltage.

As shown in FIG. 11, in the sample s3 of Comparative Example 2, the projection L51 of the remote-side edge portion is located outside the projection P1 of the forward end surface. Therefore, presumably, the ratio of generation of trigger discharge at the remote-side edge portion decreased, and the growth of plasma in the space Ar1 was restrained. Presumably, for the same reason, the growth of plasma in the space Ar1 was restrained in the sample s2 of Comparative Example 1 as well. In the experiment for the sample s3 of Comparative Example 2, the growth of plasma was restrained as compared with the sample s1, presumably because an alternating voltage including a plurality of peak voltages was not applied to the center electrode after application of the trigger voltage. In the experiment for the sample s4 of Comparative Example 3 as well, the growth of plasma was restrained as compared with the sample s1, presumably because an alternating voltage including a plurality of peak voltages was not applied to the center electrode after application of the trigger voltage. Meanwhile, in the case of the sample s1 of the first embodiment, an alternating voltage including a plurality of peak voltages was applied to the center electrode 20 after application of the trigger voltage. Therefore, presumably, the growth of plasma was promoted. In addition, since the projection L10 of the remote-side edge portion is located within the projection P1 of the forward end surface S1, presumably, the ratio of generation of trigger discharge at the remote-side edge portion become high, and the plasma grew greatly in the relatively large space Ar1.

E2. Second Example:

There were manufactured four samples (samples s5 to s8) of the above-described first embodiment, one sample (sample s9) of the second embodiment, two samples (samples s10 and s11) of the third embodiment, and one sample (sample s12) of the fourth embodiment. Also, there were manufactured samples of four comparative examples (a sample s13 of Comparative Example 4, a sample s14 of Comparative Example 5, a sample s15 of Comparative Example 6, and a sample s16 of Comparative Example 7).

The four samples s5 to s8 of the first embodiment differ from one another in terms of the size of the forward end surface S1 and the size of the facing end surface S2. Notably, the specific sizes of the forward end surface S1 and the facing end surface S2 of each of the samples s5 to s8 will be described later.

Figure 13:
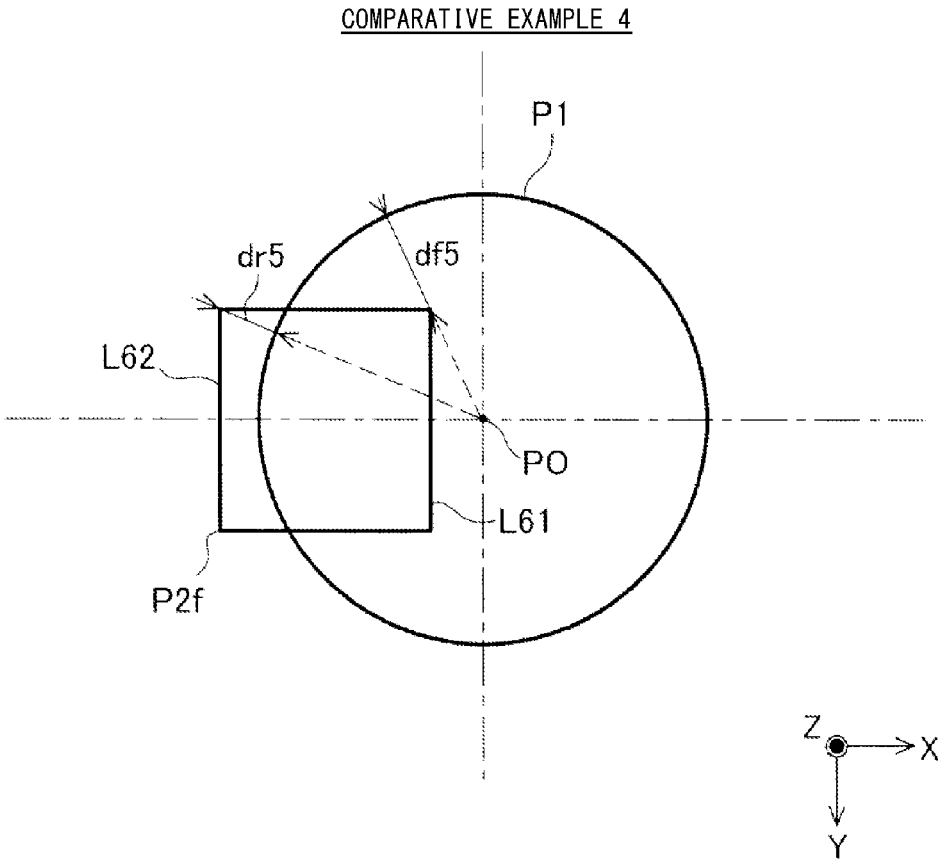
FIG. 13 is an explanatory view showing projection of the forward end surface and the facing end surface onto the plane orthogonal to the axial direction in Comparative Example 4 (sample s13).

FIG. 13 is an explanatory view showing projection of the forward end surface and the facing end surface onto the plane orthogonal to the axial direction in Comparative Example 4 (sample s13). The sample s13 of Comparative Example 4 differs from the ignition plug 100 of the first embodiment (samples s5 to s8) in terms of the size of the facing end surface and the relative positional relation between the forward end surface and the facing end surface. The remaining structure is identical with that of the ignition plug 100 of the first embodiment (samples s5 to s8).

In the sample s13 of Comparative Example 4, the length of the projection P2*f* of the facing end surface in the X-axis direction is smaller than the length of the projection P2*f* in the Y-axis direction. In Comparative Example 4, as in the first embodiment, the projection L61 of the remote-side edge portion, which is a portion of the projection P2*f* of the facing end surface, is located within the projection P1 of the forward end surface. However, in Comparative Example 4, unlike the first embodiment, the projection P2*f* of the facing end surface and the projection P0 of the center of the forward end surface S1 do not overlap with each other. In addition, in Comparative Example 4, unlike the first embodiment, the distance df5 between the projection L61 of the remote-side edge portion and the circumference of the projection P1 of the forward end surface is greater than the distance dr5 between the projection L62 of the near-side edge portion and the circumference of the projection P1 of the forward end surface.

Figure 14:
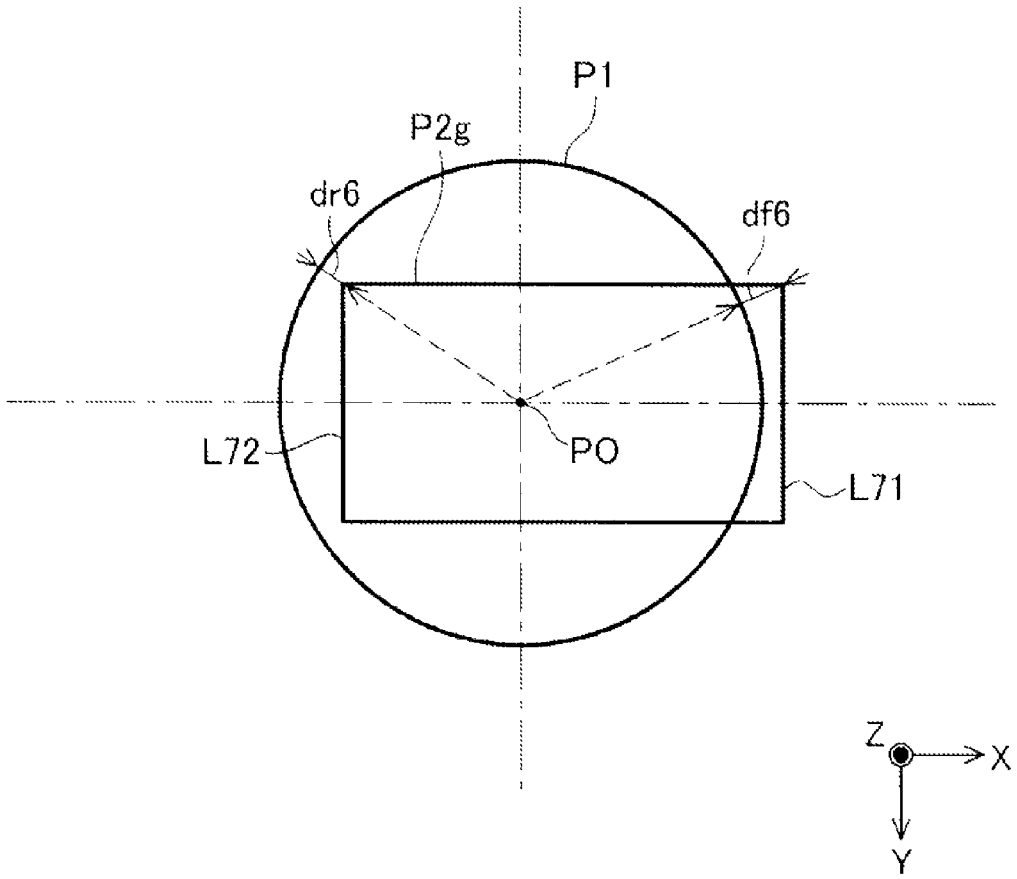
FIG. 14 is an explanatory view showing projection of the forward end surface and the facing end surface onto the plane orthogonal to the axial direction in Comparative Example 5 (sample s14).

FIG. 14 is an explanatory view showing projection of the forward end surface and the facing end surface onto the plane orthogonal to the axial direction in Comparative Example 5 (sample s14). The sample s14 of Comparative Example 5 differs from the ignition plug 100 of the first embodiment (samples s5 to s8) in terms of the relative positional relation between the forward end surface and the facing end surface. The remaining structure is identical with that of the ignition plug 100 of the first embodiment (samples s5 to s8).

In Comparative Example 5, unlike the first embodiment, the projection L71 of the remote-side edge portion, which is a portion of the projection P2*g* of the facing end surface, is located outside the projection P1 of the forward end surface. Also, the projection L72 of the near-side edge portion, which is a portion of the projection P2*g*, is located within the projection P1 of the forward end surface. In addition, in Comparative Example 5, unlike the first embodiment, the distance df6 between the projection L71 of the remote-side edge portion and the circumference of the projection P1 of the forward end surface is greater than the distance dr6 between the projection L72 of the near-side edge portion and the circumference of the projection P1 of the forward end surface. Notably, in Comparative Example 5, as in the first embodiment, the projection P2*g* of the facing end surface and the projection P0 of the center of the forward end surface S1 overlap with each other.

Figure 15:
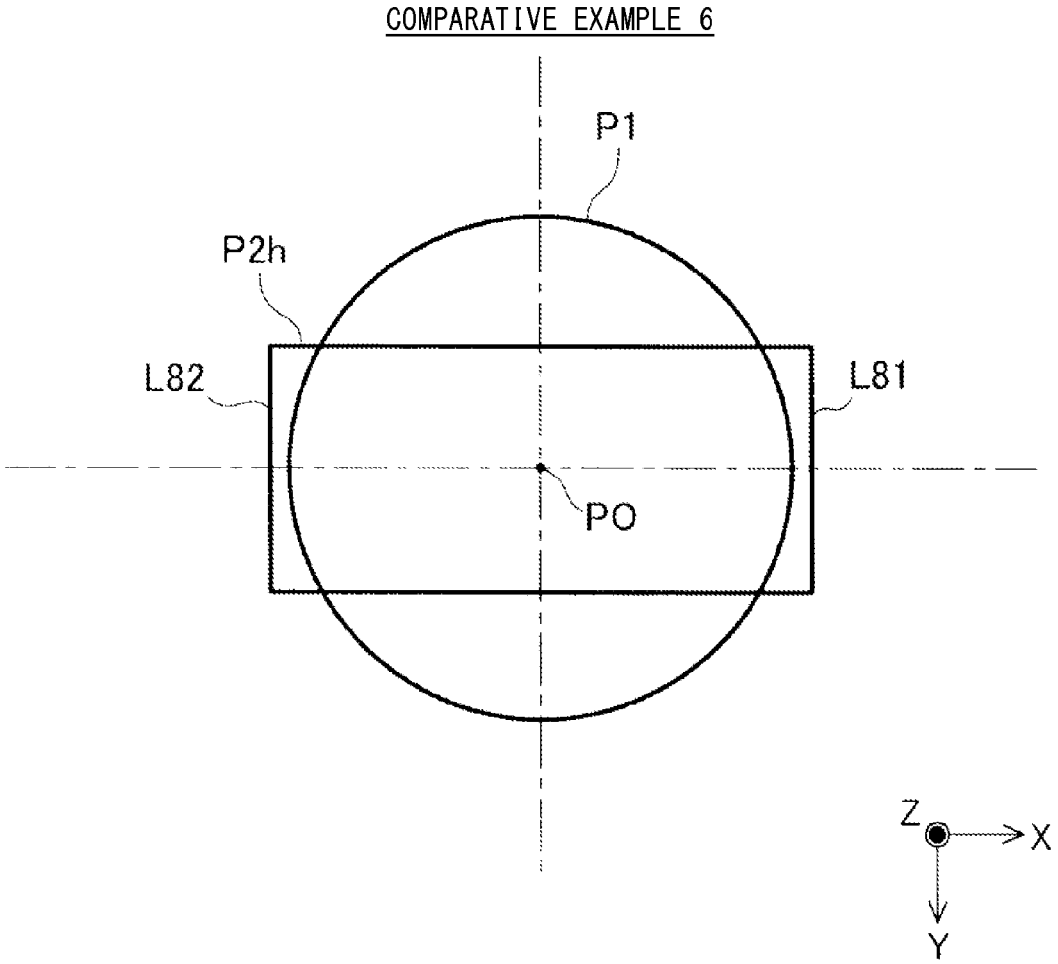
FIG. 15 is an explanatory view showing projection of the forward end surface and the facing end surface onto the plane orthogonal to the axial direction in Comparative Example 6 (sample s15).

FIG. 15 is an explanatory view showing projection of the forward end surface and the facing end surface onto the plane orthogonal to the axial direction in Comparative Example 6 (sample s15). The sample s15 of Comparative Example 6 differs from the ignition plug 100 of the first embodiment (samples s5 to s8) in terms of the relative positional relation between the forward end surface and the facing end surface. The remaining structure is identical with that of the ignition plug 100 of the first embodiment (samples s5 to s8).

In Comparative Example 6, unlike the first embodiment, the projection L81 of the remote-side edge portion, which is a portion of the projection P2*h* of the facing end surface, is located outside the projection P1 of the forward end surface. Also, the projection L82 of the near-side edge portion, which is a portion of the projection P2*h*, is located outside the projection P1 of the forward end surface. Notably, in Comparative Example 6, as in the first embodiment, the projection P2*h* of the facing end surface and the projection P0 of the center of the forward end surface S1 overlap with each other.

Figure 16:
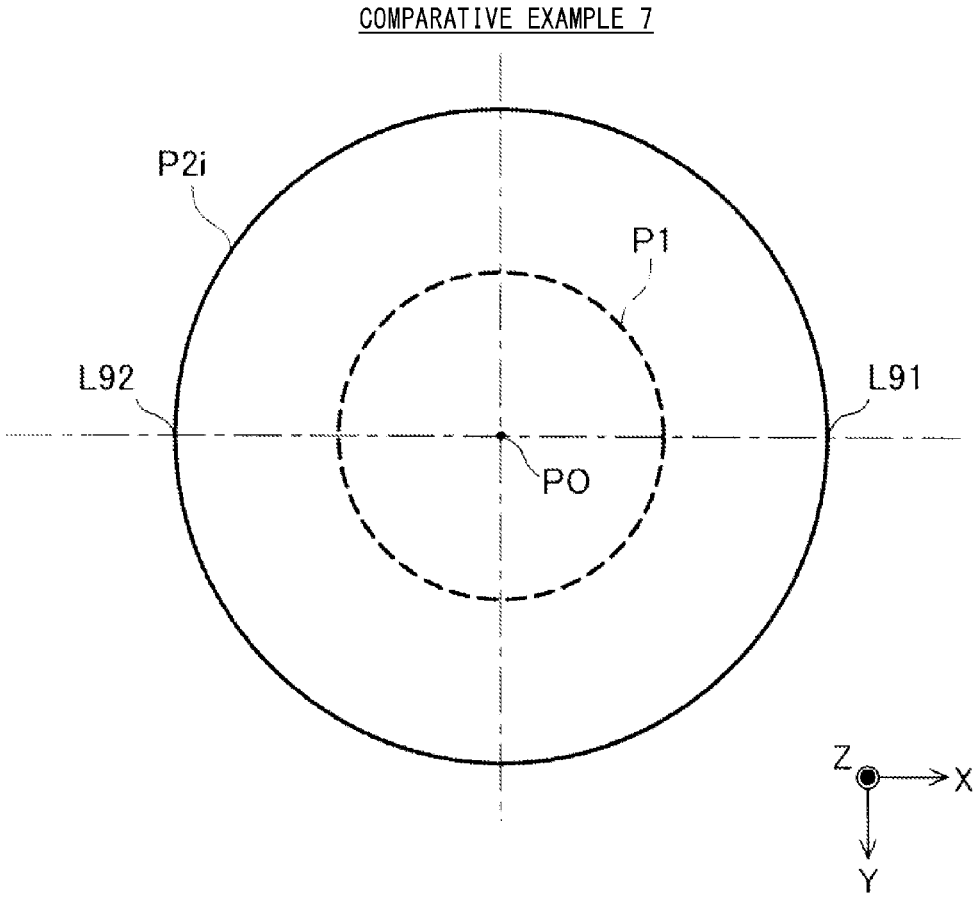
FIG. 16 is an explanatory view showing projection of the forward end surface and the facing end surface onto the plane orthogonal to the axial direction in Comparative Example 7 (sample s16).

FIG. 16 is an explanatory view showing projection of the forward end surface and the facing end surface onto the plane orthogonal to the axial direction in Comparative Example 7 (sample s16). The sample s16 of Comparative Example 7 differs from the ignition plug 100 of the first embodiment (samples s5 to s8) in terms of the shape of the facing end surface (the electrode tip) and the relative positional relation between the forward end surface and the facing end surface. The remaining structure is identical with that of the ignition plug 100 of the first embodiment (samples s5 to s8).

In the sample s16 of Comparative Example 7, the shape of the facing end surface is circular as in the fourth embodiment. In the sample s16 of Comparative Example 7, the diameter of the facing end surface is greater than the diameter of the forward end surface. Also, the center of the facing end surface and the center of the forward end surface are disposed at the same position as viewed from the Z-axis direction. Therefore, as shown in FIG. 16, the entirety of the projection P1 of the forward end surface is located within the projection P2*i* of the facing end surface. Also, the circumference of the projection P2*i* of the facing end surface is located outside the projection P1 of the forward end surface. Accordingly, both of the projection L91 of the remote-side edge portion of the facing end surface and the projection L92 of the near-side edge portion of the facing end surface are located outside the projection P1 of the forward end surface.

A test for evaluating a ratio at which the discharge path of trigger discharge is a region near the space Ar1 (this test will be referred to as the "discharge ratio evaluation test") was carried out by using the samples s5 to s16 manufactured as described above. In this discharge ratio evaluation test, each of the samples s5 to s16 was attached to the combustion chamber for test, and each of the samples s5 to s16 was caused to generate trigger discharge 100 times only. The ratio of the number of times a region near the space Ar1 served as the discharge path to the total number (100) of times of trigger discharge was calculated. The higher the ratio, the better the evaluation result. This is because, the higher the ratio at which the discharge path of trigger discharge is a region near the space Ar1, the higher the possibility of generating and growing plasma in the space Ar1. Notably, the phrase "a region near the space Ar1" means a region which is parallel to the gap G and is located on the +X direction side of the remote-side edge portion of the facing end surface, when each of the samples s5 to s16 is viewed in the +Y direction. In the discharge ratio evaluation test, the combustion chamber for text (a chamber imitating a combustion chamber) was filled with air, and the internal pressure of the combustion chamber was set to 0.4 MPa.

FIG. 17 is an explanatory view showing the results of the discharge ratio evaluation test of the second example, the diameter of the forward end surface and the size of the facing end surface of each sample. In FIG. 17, the size of the facing end surface is represented by (the length in the Y-axis direction)*(the length in the X-axis direction). In FIG. 17, the evaluation results of the test are represented by symbols "XX," "CC," "BB," and "AA." The symbol "XX" represents that the ratio at which the discharge path of trigger discharge is a region near the space Ar1 is 50% or less; i.e., the worst evaluation result. The symbol "CC" represents that the ratio at which the discharge path of trigger discharge is a region near the space Ar1 is higher than 50% but not higher than 70%; i.e., the second worst evaluation result. The symbol "BB" represents that the ratio at which the route of trigger discharge is a region near the space Ar1 is higher than 70% but not higher than 90%; i.e., the second best evaluation result. The symbol "AA" represents that the ratio at which the route of trigger discharge is a region near the space Ar1 is higher than 90% but not higher than 100%; i.e., the best evaluation result.

As shown in FIG. 17, the samples s5 to s8 corresponding to the ignition plug 100 of the first embodiment differ from one another in the diameter of the forward end surface S1. Also, they differ from one another in the length of the facing end surface S2 in the X-axis direction. Of these samples s5 to s8, the samples s5 and s6 were evaluated as "AA" and the samples s7 and s8 were evaluated as "BB." Namely, the evaluation results of all the samples s5 to s8 were relatively good. Presumably, the difference between the evaluation results of the samples s5 and s6 and the evaluation results of the samples s7 and s8 was produced for the following reason. In the samples s5 and s6, since the diameter of the forward end surface S1 is equal to or greater than 1.1 mm and is relatively large, the distance between the facing end surface S2, excluding the remote-side edge portion, and the forward end surface S1 becomes relatively large. Therefore, at the time of trigger discharge, the remote-side edge portion of the facing end surface S2 is utilized more than the remaining portion of the facing end surface S2. Accordingly, the possibility that generation and growth of plasma are performed in the space Ar1 increases. In contrast, in the samples s7 and s8, since the diameter of the forward end surface S1 is equal to or less than 0.9 mm and is relatively small, the distance between the facing end surface S2, excluding the remote-side edge portion, and the forward end surface S1 becomes relatively small. Therefore, at the time of trigger discharge, a possibility that the remote-side edge portion of the facing end surface S2 is utilized relatively increases and a possibility that the near-side edge portion of the facing end surface S2 is utilized relatively decreases. Accordingly, the possibility that generation and growth of plasma are performed in the space Ar1 decreases.

As shown in FIG. 17, the evaluation result of the sample s9 corresponding to the ignition plug of the second embodiment was the best "AA" like the sample s5 corresponding to the ignition plug 100 of the first embodiment whose facing end surface has the same size as that of the sample s9. The evaluation results of the two samples s10 and s11 corresponding to the ignition plug of the third embodiment were the second best "BB." Also, the evaluation result of the sample s12 corresponding to the ignition plug of the fourth embodiment was the second best. Notably, since the shape of the facing end surface of the sample s12 is circular, in FIG. 17, the diameter (0.7 mm) of the facing end surface is used as the size of the facing end surface of the sample s12.

In contrast to the samples s5 to s12 corresponding to the ignition plugs of the first through fourth embodiments, the evaluation results of the samples s13 to s16 corresponding to the ignition plugs of Comparative Examples 4 to 7 were the worst "XX" or the second worst "CC." Specifically, the evaluation results of the sample s13 of Comparative Example 4 and the sample s16 of Comparative Example 7 were the worst "XX," and the evaluation results of the sample s14 of Comparative Example 5 and the sample s15 of Comparative Example 6 were the second worst "CC."

In the case of the sample s13 of Comparative Example 4, as shown in FIG. 13, the projection L61 of the remote-side edge portion does not overlap with the projection P0 of the center of the forward end surface. Therefore, the distance df5 between the remote-side edge portion of the facing end surface and the circumference of the forward end surface is large as compared with the first embodiment. In addition, the length of the facing end surface in the X-axis direction is smaller than the length (in the X-axis direction) of the facing end surface S2 of the first embodiment (for example, 1.7 mm, which is the length (in the X-axis direction) of the facing end surface S2 in the sample s5). Therefore, the distance dr5 between the near-side edge portion of the facing end surface and the circumference of the forward end surface is small as compared with the first embodiment. Accordingly, the possibility that the remote-side edge portion is used at the time of trigger discharge decreases relatively, and the possibility that the near-side edge portion is used at the time of trigger discharge increases relatively. Presumably, because of the above-described reason, the evaluation result of the sample s13 of Comparative Example 4 became the worst "XX."

In the case of the sample s14 of Comparative Example 5, as shown in FIG. 14, the projection L71 of the remote-side edge portion is located outside the projection P1 of the forward end surface. Therefore, the facing end surface has a portion which is closer to the projection P1 of the forward end portion as compared with the remote-side edge portion, and the ratio of generation of trigger discharge at the remote-side end portion decreases relatively. In addition, the distance df6 between the remote-side edge portion of the facing end surface and the circumference of the forward end surface is larger than the distance dr6 between the near-side edge portion of the facing end surface and the circumference of the forward end surface. Accordingly, the ratio of generation of trigger discharge at the remote-side edge portion decreases relatively, and the ratio of generation of trigger discharge at the near-side edge portion increases relatively. Presumably, because of the above-described reason, the evaluation result of the sample s14 of Comparative Example 5 became the second worst "CC."

In the case of the sample s15 of Comparative Example 6, as shown in FIG. 15, the projection L81 of the remote-side edge portion is located outside the projection P1 of the forward end surface. Therefore, as in the case of the above-described sample s14, the facing end surface has a portion which is closer to the projection P1 of the forward end portion as compared with the remote-side edge portion, and the ratio of generation of trigger discharge at the remote-side end portion decreases relatively. In addition, the distance between the remote-side edge portion of the facing end surface and the circumference of the forward end surface is approximately equal to the distance between the near-side edge portion of the facing end surface and the circumference of the forward end surface. Accordingly, the ratio of generation of trigger discharge at the remote-side edge portion decreases relatively, and the ratio of generation of trigger discharge at the near-side edge portion increases relatively. Presumably, because of the above-described reason, the evaluation result of the sample s15 of Comparative Example 6 became the second worst "CC."

In the case of the sample s16 of Comparative Example 7, as shown in FIG. 16, the projection L91 of the remote-side edge portion is located outside the projection P1 of the forward end surface. Therefore, as in the case of the above-described samples s14 and s15, the facing end surface has a portion which is closer to the projection P1 of the forward end portion as compared with the remote-side edge portion, and the ratio of generation of trigger discharge at the remote-side end portion decreases relatively. In addition, the distance between the remote-side edge portion of the facing end surface and the circumference of the forward end surface is approximately equal to the distance between the near-side edge portion of the facing end surface and the circumference of the forward end surface. Accordingly, the ratio of generation of trigger discharge at the remote-side edge portion decreases relatively, and the ratio of generation of trigger discharge at the near-side edge portion increases relatively. Presumably, because of the above-described reason, the evaluation result of the sample s16 of Comparative Example 7 became the worst "XX."

E3. Third Example:

There were manufactured three samples (samples s17 to s19) of the above-described first embodiment and three samples (samples s20 to s22) of the fourth embodiment were manufactured, and a durability evaluation test was carried out by using these six samples (samples s17 to s22).

In the durability evaluation test, each of the samples s17 to s22 was attached to the combustion chamber for test to thereby be incorporated into the ignition system 500, and was caused to continuously generate spark discharge through application of voltage for 20 hours (durability time). After elapse of 20 hours, an increase in the size of the gap G (an increase in the length thereof in the Z-axis direction) as compared with the size before the test was measured. The smaller the increase, the better the evaluation result. This is because since the size of the gap G increases with consumption of the electrode caused by spark discharge, it is possible to evaluate the samples such that the greater the size increase, the lower the durability. Notably, in the present test, the ignition frequency was 30 Hz (30 times of ignition per sec), and a current (max: 5 A) was supplied to each sample for 0.8 ms for each application of a trigger voltage.

FIG. 18 is an explanatory view showing the results of the durability evaluation test of the third example. In FIG. 18, in addition to the evaluation result of each sample, the diameter of the forward end surface in each sample, the size of the facing end surface and the thickness of the electrode tip 60 in each sample, and the areas A, B, C and the sum of the areas B and C (hereinafter referred to as the "area B+C") in each sample are shown. In FIG. 18, the evaluation results of the test are represented by symbols "BB," "AA," and "AAA." The symbol "BB" means that the size increase of the gap G was 0.2 mm or greater. The symbol "AA" means that the size increase of the gap G was not less than 0.1 mm but less than 0.2 mm. The symbol "AAA" means that the size increase of the gap G was less than 0.1 mm. In FIG. 18, the area A means the area of the forward end surface. The areas B and C and the sum B+C will be described with reference to FIG. 19.

Figure 19:
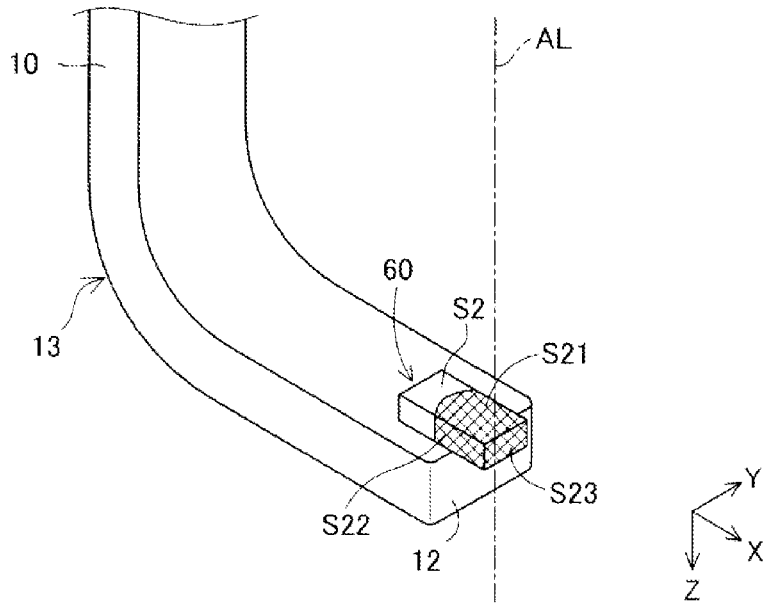
FIG. 19 is an enlarged view of a portion of the ground electrode 10 of the first embodiment in the vicinity of the other end 12 thereof.

FIG. 19 is an enlarged view of a portion of the ground electrode 10 of the first embodiment in the vicinity of the other end 12 thereof. In FIG. 19, hatching is added to a region S21 of the facing end surface S2 of the electrode tip 60 which is located within the projection of the forward end surface S1 (a region which overlaps with the projection as viewed in the axial direction), a region S22 of a first side surface of the electrode tip 60 which is located within the projection of the forward end surface S1, and a region S23 of a second side surface of the electrode tip 60 which is located within the projection of the forward end surface S1. The above-mentioned first side surface means a surface which is adjacent to the facing end surface S2, is located on the −Y direction side of the facing end surface S2, and is parallel to the XZ plane. The above-mentioned second side surface means a surface which is adjacent to the facing end surface S2, is located on the +X direction side of the facing end surface S2, and is parallel to the YZ plane.

In the case of the samples s17 to s19, the above-mentioned area B means the area of the above-described region S21. In the case of the samples s17 to s19, the above-mentioned area C means the sum of the areas of regions of the side surfaces adjacent to the facing end surface S2, which regions are located within the projection of the forward end surface S1. Specifically, the area C means the sum of the area of the above-mentioned region S22, the area of the above-mentioned region S23, and the area of a region of an unillustrated third side surface which is located within the projection of the forward end surface S1. The above-mentioned third side surface means a surface which is adjacent to the facing end surface S2, is located on the +Y direction side of the facing end surface S2, and is parallel to the XZ plane.

Notably, since the area B in the samples s20 to s22 is the same as the area B in the samples s17 to s19, the description of the area B is not repeated. Similar to the above-described area C in the samples s17 to s19, the area C in the samples s20 to s22 means the sum of regions of the side surfaces adjacent to the facing end surface S2, which regions are located within the projection of the forward end surface S1. However, since the samples s20 to s22 corresponds to the ignition plug of the fourth embodiment, the side surface adjacent to the facing end surface S2 is the side surface of the circular column.

As shown in FIG. 18, in all the samples s17 to s22, the area B is smaller than the area A. Since the area B is smaller than the area A as described above, it is possible to prevent the growth of spark discharge, generated between the forward end surface and the facing end surface, from being hindered by the electrode tip.

As shown in FIG. 18, in the sample s17, the area A (the area of the forward end surface S1) is greater than the area B+C. In the sample s18, the area A is equal to the area B+C. In the sample s19, the area A is smaller than the area B+C. In the sample s20, the area A is larger than the area B+C. In the sample s21, the area A is equal to the area B+C. In the sample s22, the area A is smaller than the area B+C.

As shown in FIG. 18, the evaluation results of the two samples s17 and s20 in which the area A is smaller than the area B+C were the best. The evaluation results of the two samples s18 and s21 in which the area A is equal to the area B+C were the second best. The evaluation results of the two samples s19 and s22 in which the area A is larger than the area B+C were the third best. Presumably, the reason why the greater the area B+C as compared with the area A, the better the durability is as follows. In all the samples s17 to s22, the area A is larger than the area B. Accordingly, in addition to the facing end surface, the side surface(s) adjacent to the facing end surface can be used for spark discharge. The larger the area C; i.e., the larger the region(s) of the side surface(s) located within the projection of the forward end surface S1, the higher the ratio at which the region(s) is used for spark discharge. Therefore, presumably, consumption of the facing end surface S2 can be suppressed, and thus, the expansion of the gap G can be delayed. For this reason, the above-mentioned samples were evaluated to be high in durability.

F. Fourth Example:

In addition to a sample of the above-described first embodiment (sample s24), samples of two comparative examples (sample s23 of Comparative Example 8 and sample s25 of Comparative Example 9) were manufactured.

Figure 25:
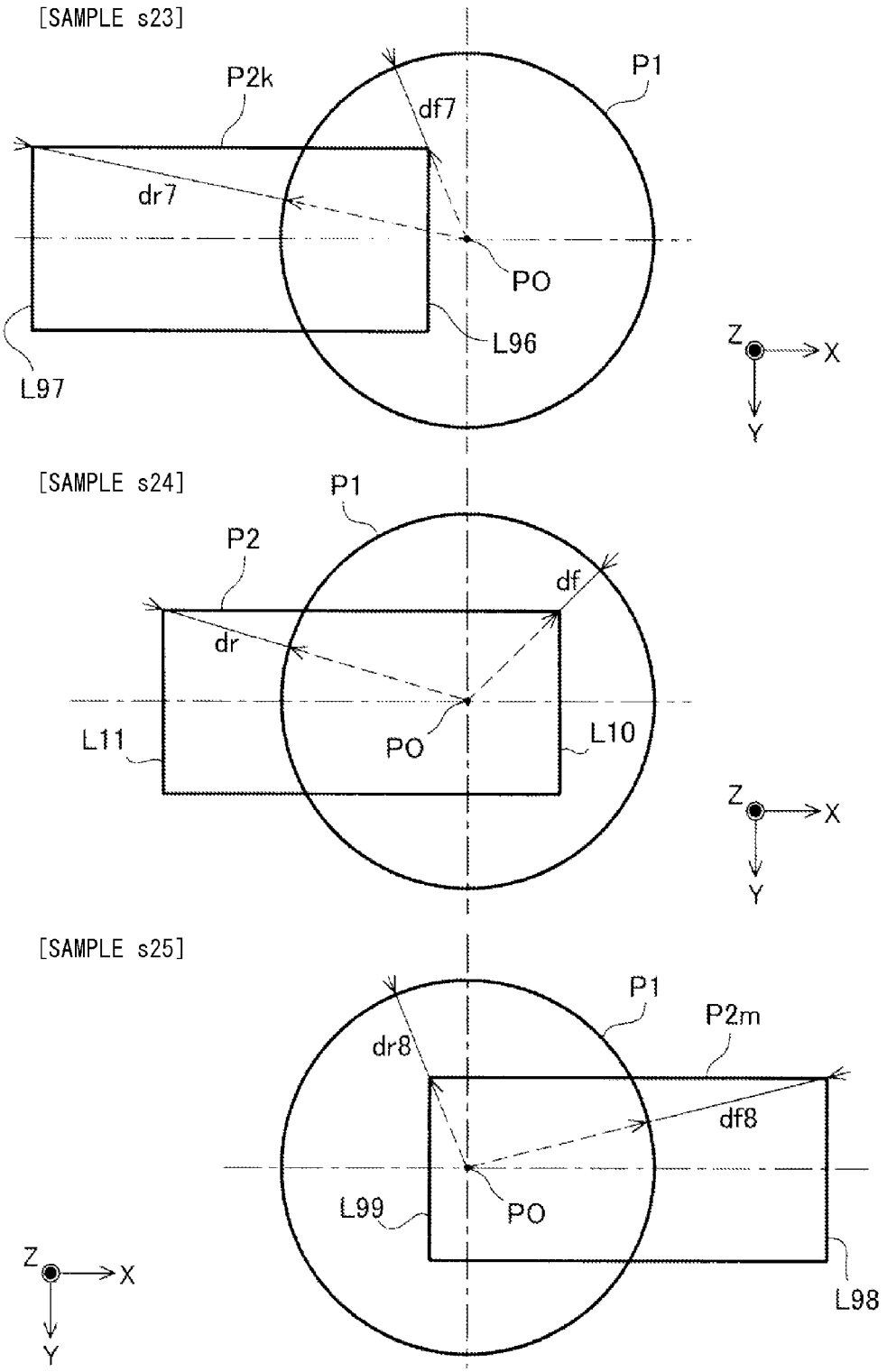
FIG. 25 is an explanatory view showing projection of the forward end surface and the facing end surface onto the plane orthogonal to the axial direction in three samples s23 through S25 of a fourth example.

FIG. 25 is an explanatory view showing projection of the forward end surface and the facing end surface onto the plane orthogonal to the axial direction in the three samples s23 through S25 in the fourth example. In FIG. 25, the upper section shows the projection for the sample s23. Also, in FIG. 25, the middle section shows the projection for the sample s24, and the lower section shows the projection for the sample s25.

The three samples s23 to s25 shown in FIG. 25 differ from one another in terms of the relative position (in the X-axis direction) of the facing end surface in relation to the center electrode, and are identical with one another in other structural features. Accordingly, the three samples s23 to s25 are identical to one another in terms of the shape and size of the facing end surface and the diameter of the center electrode. Specifically, in the three samples s23 to s25, the diameter of the forward end surface (the electrode tip) was 1.2 mm. Also, the length of the facing end surface in the lateral direction (the Y-axis direction) was 0.7 mm, and the length of the facing end surface in the longitudinal direction (the X-axis direction) was 1.7 mm.

As shown in the upper section of FIG. 25, in the sample s23, the projection L96 of the remote-side edge portion is located within the projection P1 of the forward end surface. Also, in the sample s23, the projection P2*k* of the facing end surface does not overlap with the projection P0 of the center of the forward end surface. In the sample s23, the distance df7 between the projection L96 of the remote-side edge portion and the circumference of the projection P1 of the forward end surface is smaller than the distance dr7 between the projection L97 of the near-side edge portion and the circumference of the projection P1 of the forward end surface.

As shown in the middle section of FIG. 25, in the sample s24, the projection L10 of the remote-side edge portion is located within the projection P1 of the forward end surface. Also, in the sample s24, the projection P2 of the facing end surface overlaps with the projection P0 of the center of the forward end surface. In the sample s24, the distance df between the projection L10 of the remote-side edge portion and the circumference of the projection P1 of the forward end surface is smaller than the distance dr between the projection L11 of the near-side edge portion and the circumference of the projection P1 of the forward end surface.

As shown in the lower section of FIG. 25, in the sample s25, the projection L98 of the remote-side edge portion is located outside the projection P1 of the forward end surface. Also, in the sample s25, the projection P2*m* of the facing end surface overlaps with the projection P0 of the center of the forward end surface. In the sample s25, the distance df8 between the projection L98 of the remote-side edge portion and the circumference of the projection P1 of the forward end surface is larger than the distance dr8 between the projection L99 of the near-side edge portion and the circumference of the projection P1 of the forward end surface.

A discharge ratio evaluation test and a durability evaluation test were carried out on the three samples s23 to s25 having the above-described structures. Since the method of carrying out the discharge ratio evaluation test and the evaluation method in the fourth example are identical with those in the second example, their description will not repeated. Since the method of carrying out the durability evaluation test and the evaluation method in the fourth example are identical with those in the third example, their description will not repeated.

FIG. 26 is an explanatory view showing the results of the discharge ratio evaluation test and the durability evaluation test in the fourth example. As in the case of FIG. 17, in FIG. 26, in addition to evaluation results, the diameter of the forward end surface and the size of the facing end surface in each of the samples s23 to s25 are shown. Notably, since the symbols (AA and CC) shown in FIG. 26 and representing the results of the discharge ratio evaluation test have the same meanings as the symbols shown in FIG. 17 and representing the results of the discharge ratio evaluation test, their description will not be repeated. Similarly, since the symbols (AAA and BB) shown in FIG. 26 and representing the results of the durability evaluation test have the same meanings as the symbols shown in FIG. 18 and representing the results of the durability evaluation test, their description will not be repeated.

As shown in FIG. 26, in the discharge ratio evaluation test, whereas the sample s25 was evaluated "CC," the remaining two samples s23 and s24 were evaluated "AA." Presumably, this is because, since the projection L96, L10 of the remote-side edge portion is located within the projection P1 of the forward end surface, the ratio of generation of trigger discharge at the remote-side edge portion became high.

As shown in FIG. 26, in the durability evaluation test, whereas the sample s23 was evaluated "BB," the remaining two samples s24 and s25 were evaluated "AAA." Presumably, these test results are obtained for the following reason. In the samples s24 and s25, since the facing end surface and the forward end surface are disposed such that the projection P2, P2*m* of the facing end surface overlaps with the projection P0 of the center of the forward end surface, in the ground electrode, not only the facing end surface of the electrode tip but also the side surfaces of the electrode tip can be utilized for trigger discharge. Therefore, presumably, local consumption of the ground electrode was suppressed, and thus, the expansion of the gap G was able to be delayed.

As can be understood from the above-described fourth example as well, growth of plasma in the space Ar1 can be promoted and the spark-consumption resistance of the ground electrode can be enhanced by configuring the ignition plug such that, when the forward end surface and the facing end surface are projected onto a plane orthogonal to the axial direction of the center electrode, the projection of the center of the forward end surface and the projection of the facing end surface overlap with each other, and the projection of the remote-side edge portion is located within the projection of the forward end surface.

Figure 20:
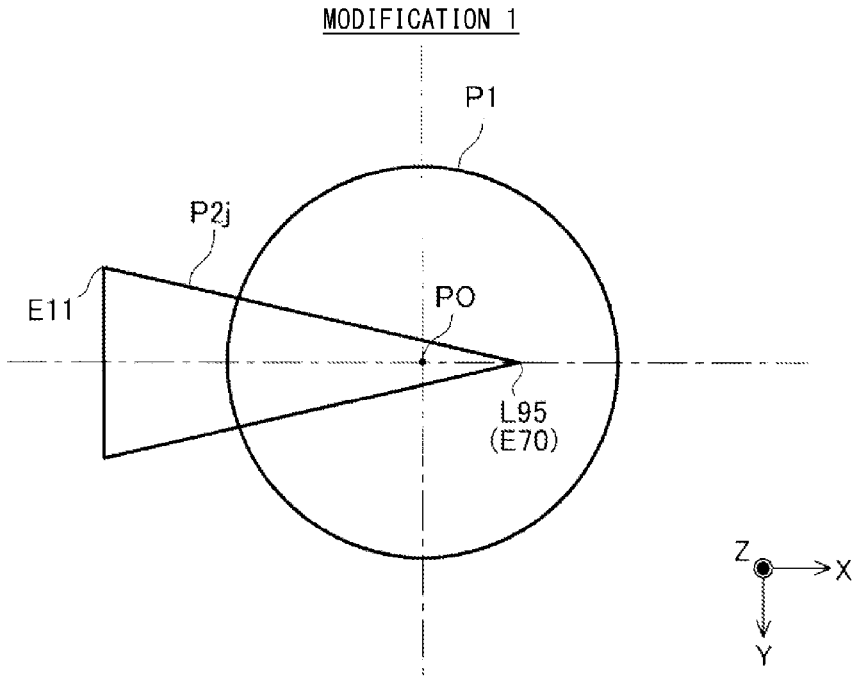
FIG. 20 is an explanatory view showing projection of the forward end surface and the facing end surface onto the plane orthogonal to the axial direction in Modification 1.

G. Modifications:

G1. Modification 1:

In the embodiments and the examples, the shape of the projection of the facing end surface is rectangular, hexagonal, or circular. However, the shape of the projection of the facing end surface is not limited to these shapes, and an arbitrary shape may be employed. FIG. 20 is an explanatory view showing projection of the forward end surface and the facing end surface onto the plane orthogonal to the axial direction in Modification 1. In FIG. 20, the projection P2*j* of the facing end surface has a triangular peripheral shape (contour). The projection P2*j* and the projection P0 of the center of the forward end surface S1 overlap with each other. The projection L95 of the remote-side edge portion of the facing end surface corresponds to the single apex E70 of the projection P2*j*. This projection L95 is located within the projection P1 of the forward end surface S1. The ignition plug of Modification 1 having the above-described structure also have advantageous effects similar to those of the ignition plug 100 of the first embodiment.

Figure 21:
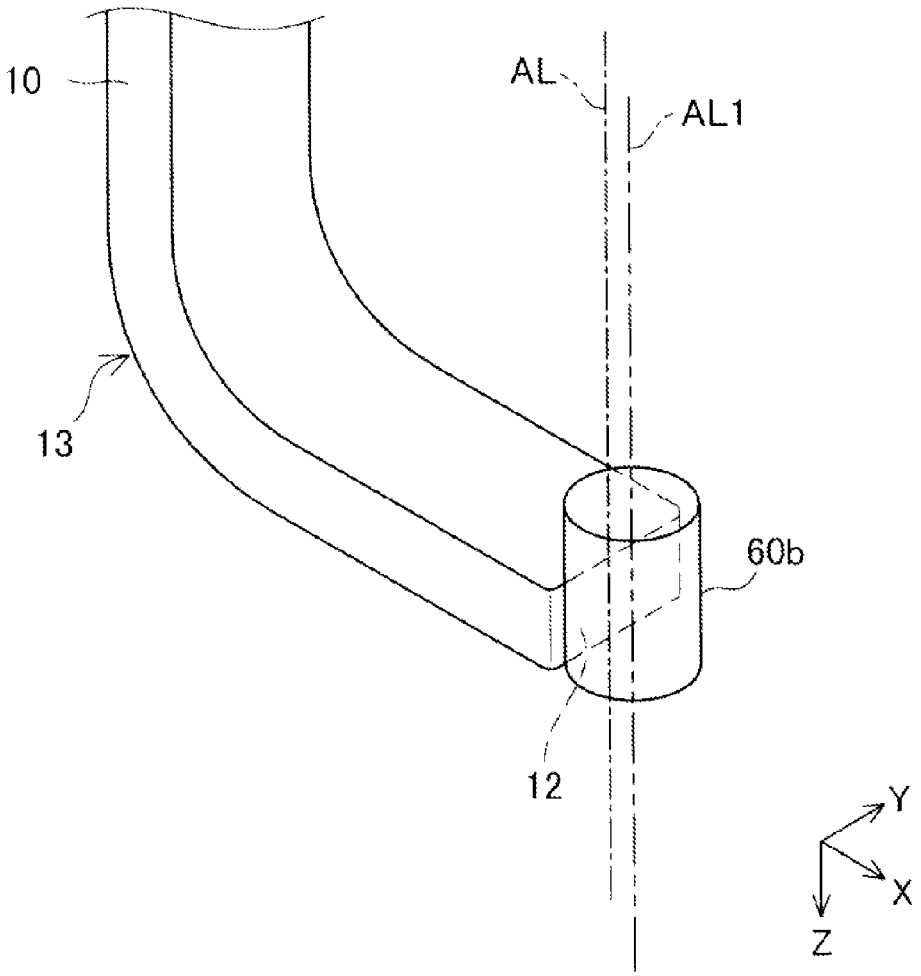
FIG. 21 is a first enlarged view of a portion of the ground electrode 10 in the vicinity of the other end 12 thereof in Modification 2.
Figure 22:
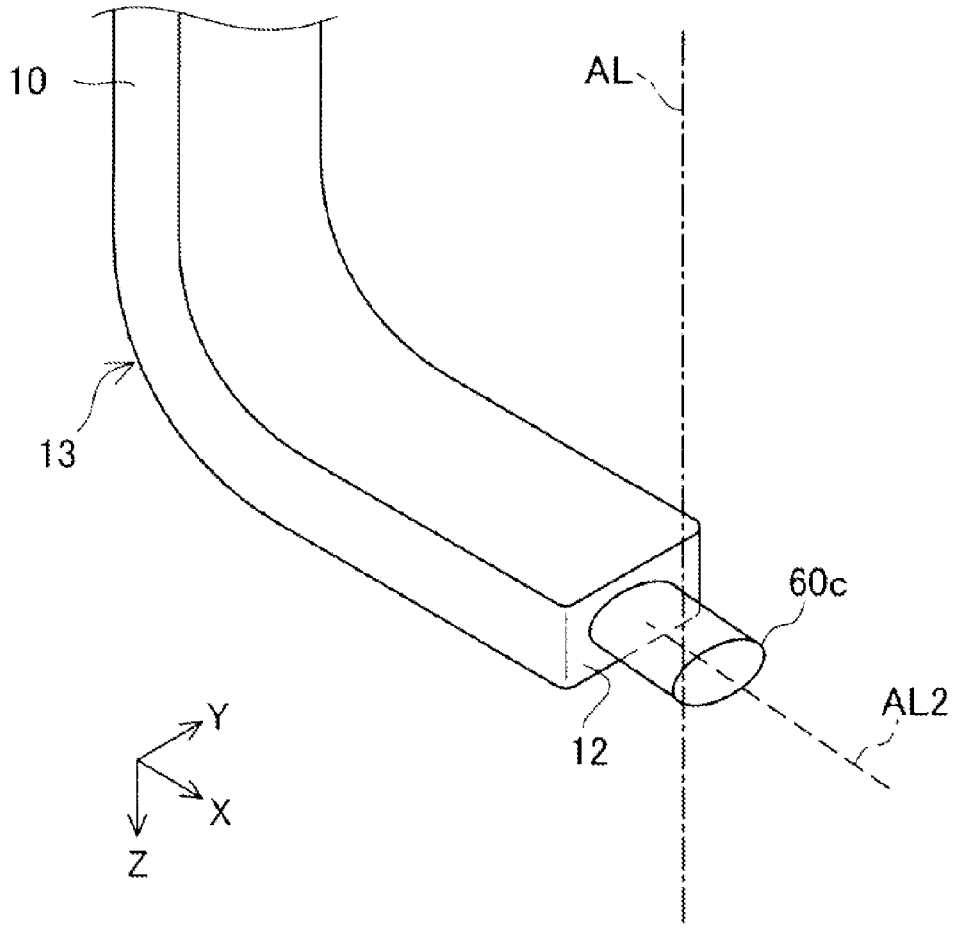
FIG. 22 is a second enlarged view of a portion of the ground electrode 10 in the vicinity of the other end 12 thereof in Modification 2.

G2. Modification 2:

In the embodiments and the examples, the electrode tip 60, 60*a* joined to the base member is provided on a selected surface of the ground electrode 10 among all the surfaces thereof, which selected surface faces the forward end of the center electrode 20 (the forward end of the electrode tip 70). However, the present invention is not limited thereto. FIG. 21 is a first enlarged view of a portion of the ground electrode 10 in the vicinity of the other end 12 thereof in Modification 2. FIG. 22 is a second enlarged view of a portion of the ground electrode 10 in the vicinity of the other end 12 thereof in Modification 2.

As shown in FIGS. 21 and 22, an electrode tip 60*b* or 60*c* may be joined to the other end 12 of the ground electrode 10. As shown in FIG. 21, the electrode tip 60*b* has a circular columnar external shape, and its axial line AL1 is parallel to the axial line AL. As shown in FIG. 22, the electrode tip 60*c* has an elliptical columnar external shape, and its axial line AL2 is parallel to the X axis. When a surface (side surface) of the electrode tip 60*c* which faces the forward end surface S1 is projected onto a plane orthogonal to the axial direction, the projection of the surface (side surface) has a rectangular shape whose longitudinal direction coincides with the X-axis direction.

G3. Modification 3:

In the embodiments and examples, of the voltages applied to the ignition plug, the voltage supplied to the ignition plug after the trigger voltage is so-called AC voltage whose polarity repeatedly changes between negative polarity and positive polarity. However, the present invention is not limited thereto.

Figure 23:
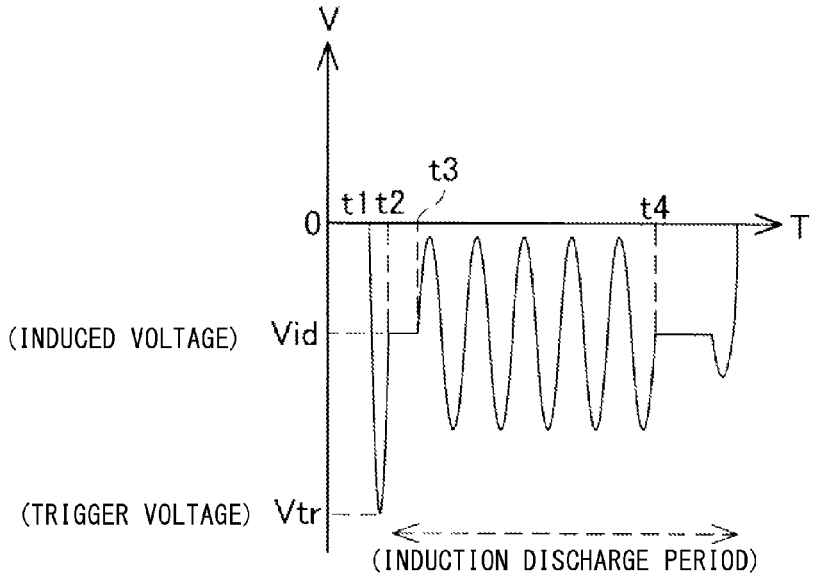
FIG. 23 is a first timing chart showing an example of a voltage applied to the ignition plug in Modification 3.

FIG. 23 is a first timing chart showing an example of the voltage applied to the ignition plug in Modification 3. Since the horizontal and vertical axes in FIG. 23 are the same as the horizontal and vertical axes in FIG. 3, their description will not be repeated. In the example shown in FIG. 23, after application of the trigger voltage, a voltage including a plurality of peak voltages is applied to the ignition plug as in the case of the embodiments and the example. The plurality of peak voltages correspond to the peak voltages of a periodical voltage which has a predetermined amplitude and whose center value corresponds to the induced voltage Vid. In the example shown in FIG. 23, the voltage is negative in polarity at each of the plurality of peaks. Even in a configuration in which such an application voltage is used, since the trend of voltage change periodically changes from a decrease trend to an increase trend and changes from the increase trend to the decrease trend, growth of plasma can be promoted. Notably, the value (absolute value) of the induced voltage Vid in the configuration shown in FIG. 23 may be set to an arbitrary value equal to or higher than double the value (absolute value) of the induced voltage Vid in the first embodiment shown in FIG. 3.

Figure 24:
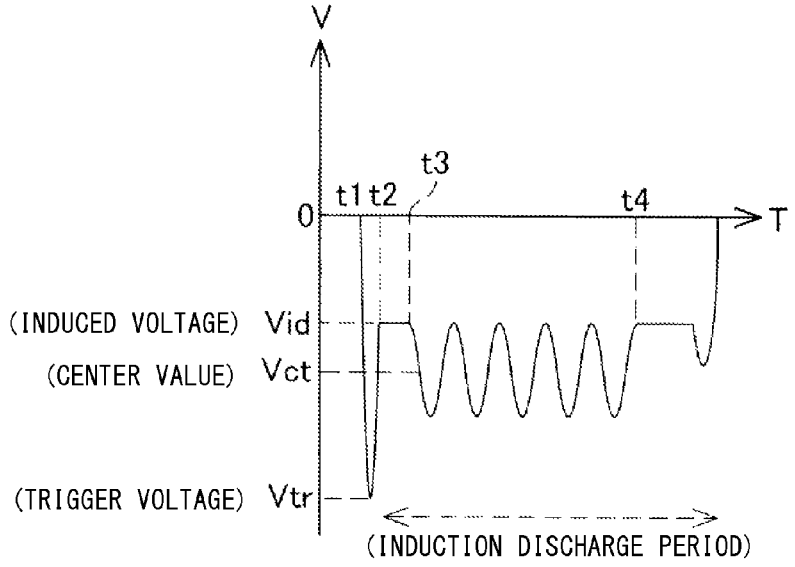
FIG. 24 is a second timing chart showing an example of a voltage applied to the ignition plug in Modification 3.

FIG. 24 is a second timing chart showing another example of the voltage applied to the ignition plug in Modification 3.

Since the horizontal and vertical axes in FIG. 24 are the same as the horizontal and vertical axes in FIG. 3, their description will not be repeated. In the example shown in FIG. 24, after application of the trigger voltage, a periodical voltage having negative peak voltages is applied to the ignition plug, as in the case of the example shown in FIG. 23. However, the application voltage shown in FIG. 24 differs from the application voltage shown in FIG. 23 in that the center value Vct of the periodical voltage is lower than the induced voltage Vid (the absolute value is larger than that of the induced voltage Vid). Even in a configuration in which the application voltage shown in FIG. 24 is used, since the trend of voltage change periodically changes from a decrease trend to an increase trend and changes from the increase trend to the decrease trend, growth of plasma can be promoted.

G4. Modification 4:

In the embodiments and the examples, the end portion of the center electrode 20 (the end portion of the electrode tip 70 on the forward end side) is a smooth flat surface (the forward end surface). However, the present invention is not limited thereto. For example, the end portion of the center electrode 20 may have a smooth hemispherical surface instead of the smooth flat surface. In this structure, the hemispherical surface becomes an area in which spark is produced, and corresponds to the forward end surface in the claims. Alternatively, the end portion of the center electrode 20 may have a region (portion) which is uneven in the Z-axis direction. In this structure, the entity of the region (portion) which is uneven in the Z-axis direction becomes an area in which spark is produced, and corresponds to the forward end surface in the claims. Namely, in general, a peripheral surface of the forward-end-side end portion of the center electrode 20 within which spark is produced may be used as the forward end surface in the ignition plug of the present invention.

G5. Modification 5:

In the embodiments and the examples, the distances between the forward end surface and the facing end surface along the Z-axis direction at arbitrary two positions are equal to each other. However, the ignition plug of the present invention may be configured such that the distances between the forward end surface and the facing end surface along the Z-axis direction at arbitrary two positions differ from each other. In this case as well, it is preferred that the distance (the distance in the three-dimensional space) between the remote-side edge portion and the circumference of the forward end surface be smaller than the distance (the distance in the three-dimensional space) between the near-side edge portion and the circumference of the forward end surface. However, in the embodiments and the examples, there may be employed a structure in which the distance (the distance in the three-dimensional space) between the remote-side edge portion and the circumference of the forward end surface is equal or larger than the distance (the distance in the three-dimensional space) between the near-side edge portion and the circumference of the forward end surface. Even in such a structure, when the projection of the center of the forward end surface and the projection of the facing end surface overlap with each other and the projection of the remote-side edge portion is located within the projection of the forward end surface, the generation and growth of plasma can be promoted, and spark-consumption resistance can be enhanced.

G6. Modification 6:

In the embodiments and the examples, the center electrode 20 has the electrode tip 70 at its forward end. However, the electrode tip 70 may be omitted. Even in this structure, when the positional relation between the forward end surface (the forward-end-side end surface) of the center electrode 20 and the facing end surface of the ground electrode satisfies the positional relation in each of the embodiments and the examples, the advantageous effects of the embodiments can be attained. Similarly, in the embodiments and the examples, the ground electrode 10 has the electrode tip 60 (60*a* to 60*c*) at the other end 12. However, the electrode tip 60 (60*a* to 60*c*) may be omitted. Even in this structure, when the positional relation between the facing surface of the ground electrode which faces the forward end surface of the center electrode 20 (for example, if the ground electrode 10 has a surface which projects in the −Z-axis direction like the electrode tip 60, such a surface is used the facing surface of the ground electrode) and the forward end surface of the center electrode 20 satisfies the positional relation in each of the embodiments and the examples, the advantageous effects of the embodiments can be attained.

G7. Modification 7:

In the embodiments and the examples, the high frequency power supply 530 shown in FIG. 2 is employed so as to apply a plurality of peak voltages to the ignition plug. However, the method of applying a plurality of peak voltages to the ignition plug is not limited thereto. For example, there may be employed a method of applying a plurality of peak voltages to a single ignition plug by using a plurality of ignition coils connected in parallel such that the plurality of peak voltages from the coils are superimposed on one another.

The present invention is not limited to the above-described embodiments, examples, and modifications, and can be realized in various configurations without departing from the scope of the invention. For example, the technical features in the embodiments and the modifications which correspond to the technical features in the modes described in the "Summary of the Invention" section may be freely combined or be replaced with other technical features so as to solve some or all of the above-mentioned problems or to achieve some or all of the above-mentioned advantageous effects. Also, those technical features which are not described in the present specification as essential technical features may be freely omitted.

DESCRIPTION OF SYMBOLS

10: ground electrode
11: one end
12: the other end
13: bent portion
20: center electrode
22: resistor
23: seal
30: ceramic insulator
31: through-hole
32: leg portion
33: forward trunk portion
34: center trunk portion
35: rear trunk portion
40: metallic terminal
50: metallic shell
51: tool engagement portion
52: male screw portion
53: seat portion
54: buckling portion
55: tool engagement portion
56: crimp portion
57: end surface
59: gasket
60, 60*a* to 60*c*: electrode tip
70: electrode tip

100: ignition plug
200: engine head
500: ignition system
510: discharge power supply
511: primary coil
512: secondary coil
513: core
514: igniter
517, 518, 519: transmission path
520: battery
530: high frequency power supply
540: impedance matching circuit
550: mixing circuit
551: coil
552: capacitor
560: control section
G: gap
P0: projection
S1: forward end surface
P1, P1*a*: projection
S2: facing end surface
P2, P2*a* to P2*k*, Pm: projection
L10: projection
E10: end point
E11: end point
S21: region
L21: short side
E40: end point
S22: region
L31: short side
L22: oblique side
E41: end point
L41: projection
S23: region
L23: oblique side
L32: short side
L33: long side
L24: short side
L61: projection
L62: projection
E70: apex
L34: long side
L25: long side
L71: projection
L26: long side
L81: projection
L72: projection
L91: projection
L92: projection
L82: projection
L95: projection
L96: projection
L97: projection
L98: projection
L99: projection
AL1: axis
AL2: axis
Ar1: space
Ar2: space
Vid: induced voltage
Vct: center value Having described the invention, the following is claimed:

1. An ignition plug comprising:

a center electrode having a forward end portion that includes a forward end surface;

a tubular insulator which holds the center electrode such that the forward end portion of the center electrode projects from the insulator;

a tubular metallic shell which holds the insulator; and a ground electrode whose one end is joined to the metallic shell and whose other end is a free end, the ground electrode having:

a bent portion formed between the one end and the other end, a base member, and an electrode tip joined to the base member on the other end side of the ground electrode, the electrode tip having (i) a facing end surface which faces the forward end surface of the forward end portion of the center electrode, and (ii) side surfaces adjacent to the facing end surface, wherein the electrode tip is dimensioned to satisfy relational expressions $A>B$ and $A\leq(B+C)$, where A represents an area of the forward end surface of the center electrode, B represents an area of a region of the facing end surface which is located within the projection of the forward end surface of the center electrode, and C represents an area that is a sum of areas of regions of the side surfaces adjacent to the facing end surface and which are located within the projection of the forward end surface of the center electrode, wherein a plurality of peak voltages can be applied to the center electrode after application of a voltage for trigger discharge thereto; and when the forward end surface of the center electrode and the facing end surface are projected onto a plane orthogonal to an axial direction of the center electrode, a projection of the center of the forward end surface of the center electrode and a projection of the facing end surface overlap with each other, and a projection of a remote-side edge portion of the facing end surface which is located on a side remote from the bent portion is located within the projection of the forward end surface of the center electrode.

2. An ignition plug according to claim 1, wherein the remote-side edge portion is an edge portion of the facing end surface which is located at an end of the facing end surface on the other end side in a direction from the bent portion toward the other end.

3. An ignition plug according to claim 1, wherein a distance between the remote-side edge portion and the circumference of the forward end surface is smaller than a distance between a near-side edge portion of the facing end surface which is located on a side near the bent portion and the circumference of the forward end surface.

4. An ignition plug according to claim 3, wherein the near-side edge portion is an edge portion of the facing end surface which is located at an end of the facing end surface on the bent portion side in a direction from the other end toward the bent portion.

5. An ignition plug according to claim 1, wherein the forward end surface is circular and has a diameter of 1.1 mm or greater.

6. An ignition plug according to claim 1, wherein the electrode tip is smaller in width than the base member, and at least a portion of the electrode tip projects from the base member in the direction from the bent portion toward the other end.

7. An ignition plug according to claim 1, wherein the plurality of peak voltages are peak voltages of a voltage which has a fixed amplitude and changes periodically.

8. An ignition system comprising:

an ignition plug comprising:

a center electrode having a forward end portion that includes a forward end surface;

a tubular insulator which holds the center electrode such that the forward end portion of the center electrode projects from the insulator;

a tubular metallic shell which holds the insulator; and a ground electrode whose one end is joined to the metallic shell and whose other end is a free end, the ground electrode having:

a bent portion formed between the one end and the other end, a base member, and an electrode tip joined to the base member on the other end side of the ground electrode, the electrode tip having (i) a facing end surface which faces the forward end surface of the forward end portion of the center electrode, and (ii) side surfaces adjacent to the facing end surface, wherein the electrode tip is dimensioned to satisfy relational expressions $A>B$ and $A\leq(B+C)$, where A represents an area of the forward end surface of the center electrode, B represents an area of a region of the facing end surface which is located within the projection of the forward end surface of the center electrode, and C represents an area that is a sum of areas of regions of the side surfaces adjacent to the facing end surface and which are located within the projection of the forward end surface of the center electrode, wherein a plurality of peak voltages can be applied to the center electrode after application of a voltage for trigger discharge thereto; and when the forward end surface of the center electrode and the facing end surface are projected onto a plane orthogonal to an axial direction of the center electrode, a projection of the center of the forward end surface of the center electrode and a projection of the facing end surface overlap with each other, and a projection of a remote-side edge portion of the facing end surface which is located on a side remote from the bent portion is located within the projection of the forward end surface of the center electrode; and a voltage supply section which supplies the voltage for trigger discharge and the plurality of peak voltages to the center electrode.

* * * * *